US006963190B2

(12) United States Patent
Asanuma et al.

(10) Patent No.: US 6,963,190 B2
(45) Date of Patent: Nov. 8, 2005

(54) POWER SUPPLY APPARATUS

(75) Inventors: Kazuo Asanuma, Tokyo (JP); Yoji Imai, Tokyo (JP); Yasuo Hosaka, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 9 days.

(21) Appl. No.: 10/782,833

(22) Filed: Feb. 23, 2004

(65) Prior Publication Data

US 2004/0227497 A1 Nov. 18, 2004

(30) Foreign Application Priority Data

May 14, 2003 (JP) ..... 2003-135650

(51) Int. Cl.[7] ..... G08F 1/40
(52) U.S. Cl. ..... 323/283
(58) Field of Search ..... 323/283, 229, 323/282, 284

(56) References Cited

U.S. PATENT DOCUMENTS 5,055,767 A 10/1991 Nelson
5,278,490 A 1/1994 Smedley
5,583,752 A 12/1996 Sugimoto et al.
5,747,972 A * 5/1998 Baretich et al. ..... 323/223
5,844,403 A 12/1998 Sugimoto et al.

FOREIGN PATENT DOCUMENTS

JP A 59-144364 8/1984
JP B2 3161839 2/2001
JP A 2002-252979 9/2002

* cited by examiner

*Primary Examiner*—Shawn Riley
(74) *Attorney, Agent, or Firm*—Oliff & Berridge, PLC

(57) ABSTRACT

An object of this invention is to provide a power supply apparatus, which realizes a frequency characteristic of an open-loop transfer function having a trap point, and can deal with input fluctuation. A controller of the power supply apparatus of the invention is a circuit in which although the form of its transfer function is the same as a conventional one, values of respective coefficients are different, only a phase margin is ensured without ensuring a gain margin, and the transfer function is realized which provides a frequency range (i.e. trap point) in which a decrease in gain is remarkable and a phase is considerably delayed. Besides, in order to ensure the stability against input fluctuation, a power conversion circuit is used which converts an input voltage from an input DC power supply so as to be constant in multiplying voltage by time.

11 Claims, 18 Drawing Sheets

| | |
|---|---|
| R1 | 1KΩ |
| R2 | 98Ω |
| R3 | 710KΩ |
| R4 | 2.2KΩ |
| C1 | 2.2nF |
| C2 | 1nF |

| | |
|---|---|
| Vi | 6V |
| Vo | 2.5V |
| Io | 1A(max) |
| L | 3μH |
| C | 9.4μF |
| Ro | 2.5Ω |
| Vref | 2.5V |
| Kp | 10 TIMES |

| | |
|---|---|
| R1 | 1KΩ |
| R2 | 60Ω |
| R3 | 430KΩ |
| R4 | 1.4KΩ |
| C1 | 3.3nF |
| C2 | 1.8nF |

| | |
|---|---|
| Vi | 8.0V |
| Vo | 2.5V |
| L | 3μH |
| C | 9.4μF |
| Ro | 2.5Ω |
| Kp | 22dB |
| R1 | 10KΩ |
| R2 | 940Ω |
| R4 | 14KΩ |
| C1 | 230pF |
| C2 | 200pF |

POWER SUPPLY APPARATUS

TECHNICAL FIELD OF THE INVENTION

This invention relates to a power supply apparatus, and more particularly to feedback control technology in the power supply apparatus.

BACKGROUND OF THE INVENTION

The technology to improve the response of the power supply apparatus is described, for example in U.S. Pat. No. 5,844,403 and U.S. Pat. No. 5,583,752. However, because the technology described in the aforementioned patents assumes that an imaginary-number type PID (P: Proportional element; I: Integral element; D: Differential element) control is used, there are some problems that it is difficult to design a control circuit, and when the control circuit is realized, the number of necessary components becomes large.

SUMMARY OF THE INVENTION

Therefore, an object of this invention is to provide a power supply apparatus, which can achieve high-speed response, with a highly practical configuration.

A power supply apparatus according to a first aspect of this invention comprises: a power conversion circuit for converting an input voltage from an input power supply into a predetermined voltage; an input fluctuation control circuit connected to the power conversion circuit, for suppressing fluctuation of the input voltage; an LC filter for smoothing an output of the power conversion circuit and supplying the smoothed output of the power conversion circuit to a load; and a control circuit for controlling the power conversion circuit based on an output voltage of the LC filter, and wherein an open-loop transfer function calculated by a transfer function of the power conversion circuit, a transfer function of the LC filter and the load, and a transfer function of the control circuit realizes a frequency characteristic having a phase trap.

Incidentally, the input fluctuation control circuit may control the output of the power conversion circuit so as to be constant in multiplying voltage by time.

Furthermore, the input fluctuation control circuit may comprise a circuit for generating a first signal whose inclination varies in accordance with the input voltage; a circuit for comparing the first signal with a second signal from the control circuit, and outputting a third signal if a voltage of the first signal becomes an voltage of the second signal or more; and a circuit for generating a driving signal that is turned ON in response to a clock signal and is turned OFF in response to the third signal.

Incidentally, the frequency characteristic having the phase trap may be a frequency characteristic without a gain margin. In addition, the frequency characteristic having the phase trap may be a frequency characteristic having only a phase margin of the gain margin and the phase margin. Furthermore, the frequency characteristic having the phase trap may be a frequency characteristic in which a gain exceeds 0 dB at a frequency at which a phase becomes −180 degrees. Incidentally, the frequency at which the phase becomes −180 degrees may be set within a frequency range from a resonant frequency of the LC filter to a gain crossover frequency.

Besides, the frequency characteristic having the phase trap may be a frequency characteristic in which a gain exceeds 0 dB at a frequency at which a phase is most delayed. The frequency at which the phase is most delayed may be set within a frequency range from the resonant frequency of the LC filter to the gain crossover frequency.

An power supply apparatus according to a second aspect of the invention comprises a power conversion circuit for converting an input voltage from an input power supply into a predetermined voltage; an input fluctuation control circuit connected to the power conversion circuit, for suppressing fluctuation of the input voltage; an LC filter for smoothing an output of the power conversion circuit and supplying the smoothed output of the power conversion circuit to a load; and a control circuit for controlling the power conversion circuit based on an output voltage of the LC filter, and wherein the control circuit has a PID control function, and an integral control element thereof is applied at frequencies higher than a resonant frequency of the LC filter.

Moreover, the aforementioned control circuit may be a circuit in which a differential control element of the PID control function is applied at frequencies lower than the gain crossover frequency.

Incidentally, although concrete examples will be explained in later, there are a lot of circuits, which achieve the transfer function in the first and second aspects of the invention, and any of such circuits can be used. In addition, there are a lot of circuits, which achieve the aforementioned input fluctuation control circuit, and any of such circuits can be used.

DETAILED DESCRIPTION OF THE PREFERRED EMBODIMENTS

Figure 1:
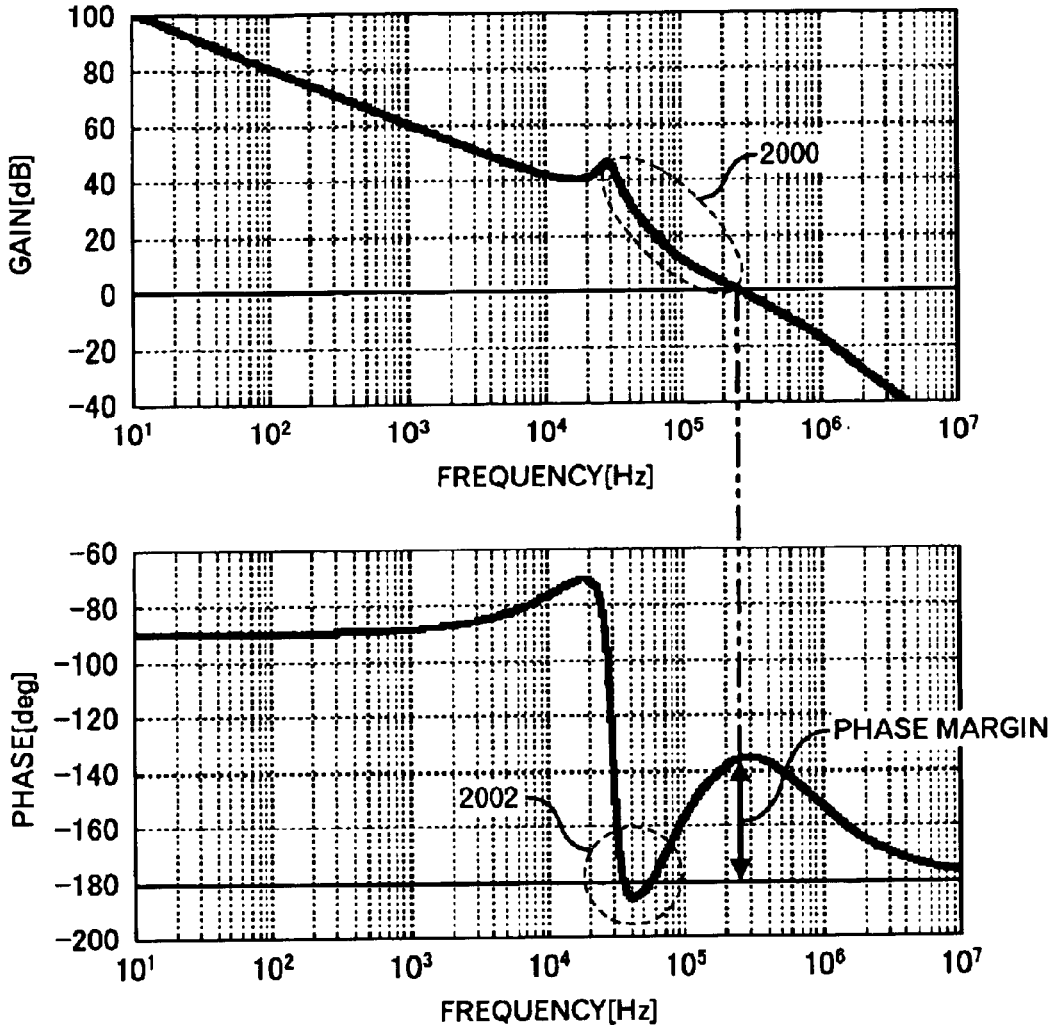
FIG. 1 is a diagram showing a Bode diagram of an open-loop transfer function as a premise.

In order to ensure high-speed response in a power supply apparatus, it is believed to be effective to realize a frequency characteristic of an open-loop transfer function as shown in FIG. 1 by a controller. The upper diagram of FIG. 1 shows a frequency characteristic of a gain, and the lower portion thereof shows a frequency characteristic of a phase. In these frequency characteristics of the gain and the phase, while a phase margin expressing a phase angle from −180 degrees at a gain crossover frequency (frequency at which the gain is 0 dB) is sufficiently (for example, from approximately 45 degrees to 60 degrees) ensured, a gain margin as a gain amount at a minus side when the phase is delayed by −180 degrees is not ensured. It is known that the stability is sufficiently secured if only the phase margin is ensured.

Besides, in the frequency characteristic of the phase, as indicated by a dotted line 2002, there is provided a phase trap (hereinafter referred to as a "trap point") in which the phase is considerably delayed in a state where the gain is 0 dB or more. At the trap point, as shown in FIG. 1, there is also a case where the phase becomes lower than −180 degrees. As shown by a dotted line 2000, because the gain curve can be steeply inclined by providing such a trap point, high-speed response becomes possible as compared with a controller normally designed so as to use the same gain crossover frequency. In general, in order to improve the response of a control system, a gain crossover frequency has only to be made high. However, in the case of a switching power supply, because there is a limit that the gain crossover frequency can not exceed a switching frequency (theoretically, the gain crossover frequency is half or less of the switching frequency), it becomes a serious point to find a way to improve the response to the greatest extent possible in the state where the upper limit of the gain crossover frequency is fixed. In this point, if the characteristic shown in FIG. 1 can be realized, the high-speed response becomes possible without raising the gain crossover frequency, and therefore, this is effective.

Figure 2:
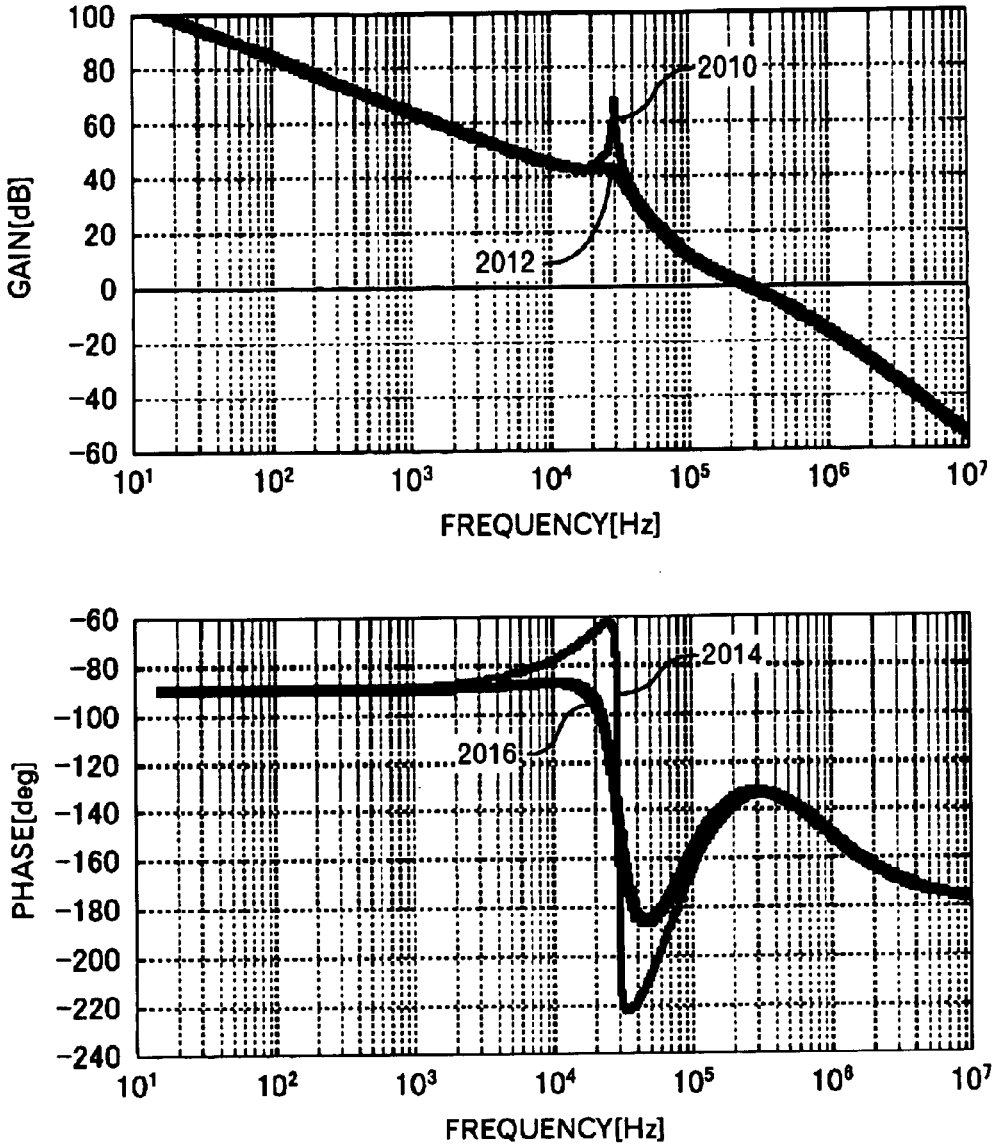
FIG. 2 is a Bode diagram showing fluctuation in a frequency characteristic of the open-loop transfer function at the time of load fluctuation.

However, the Bode diagram shown in FIG. 1 shows the frequency characteristic in a certain constant state, and actually, because there is a fluctuation element such as input fluctuation or load fluctuation, it is not necessarily possible to maintain the frequency characteristic as shown in FIG. 1. FIG. 2 shows an example of the fluctuation of the frequency characteristic in the case where the load fluctuation occurs. The upper diagram of FIG. 2 shows a frequency characteristic of a gain, and the lower diagram shows a frequency characteristic of a phase. For example, in the case where the load resistance is 25 Ω, the gain curve becomes a curve 2010, and in the case where it is 1.25 Ω, the gain curve becomes a curve 2012. Thus, when the load resistance becomes large, a resonant characteristic sharply appears. On the other hand, in the case where the load resistance is 25 Ω, the phase curve becomes a curve 2014, and in the case where it is 1.25 Ω, the phase curve becomes a curve 2016. Thus, when the load resistance becomes large, the depth of the trap point becomes deep. However, the gain crossover frequency is hardly changed, and the phase delay at the gain crossover frequency is hardly changed, so that the phase margin is hardly changed. Accordingly, the load fluctuation does not have a large influence on the stability.

Figure 3:
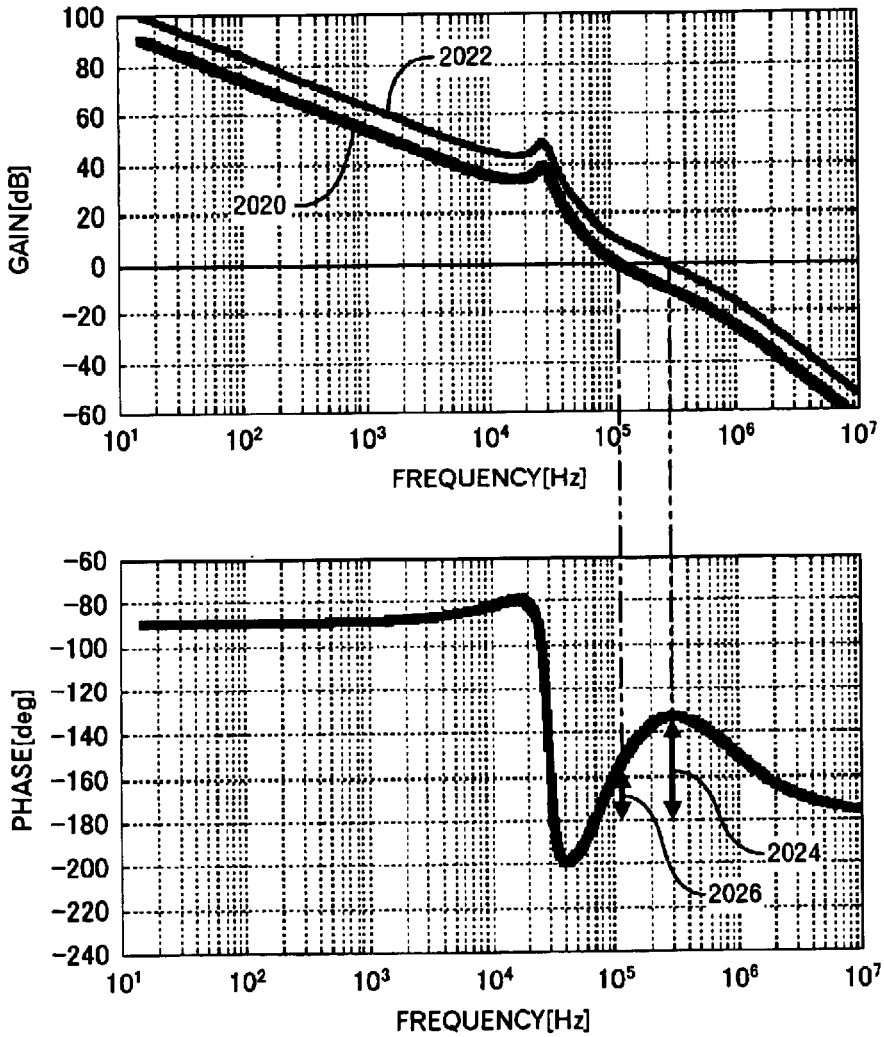
FIG. 3 is a Bode diagram showing fluctuation in a frequency characteristic of the open-loop transfer function at the time of input fluctuation.

However, in the case where the input fluctuation occurs, a large influence is given. FIG. 3 shows an example of a fluctuation in frequency characteristic in the case where the input fluctuation occurs. The upper diagram of FIG. 3 shows a frequency characteristic of a gain, and the lower diagram shows a frequency characteristic of a phase. For example, in the case where an input voltage is 4 V, a gain curve becomes a curve 2020, and in the case where an input voltage is 12 V, a gain curve becomes a curve 2022. Thus, although the shape is slightly changed, when the input voltage is lowered, the gain curve moves in parallel in the direction of lowering the gain. Accordingly, when the input voltage is lowered, the gain crossover frequency is also lowered. On the other hand, the phase curve is hardly changed. Thus, although a phase margin 2024 at the time of the input voltage of 12 V is about 45 degrees, a phase margin 2026 at the time of the input voltage of 4 V is about 25 degrees. This is because the phase angle goes down the valley of the trap point provided on the phase curve, because the gain crossover frequency is lowered.

As described above, it is understood that the input fluctuation has a large influence on the stability in the analysis of the frequency characteristic.

Figure 4:
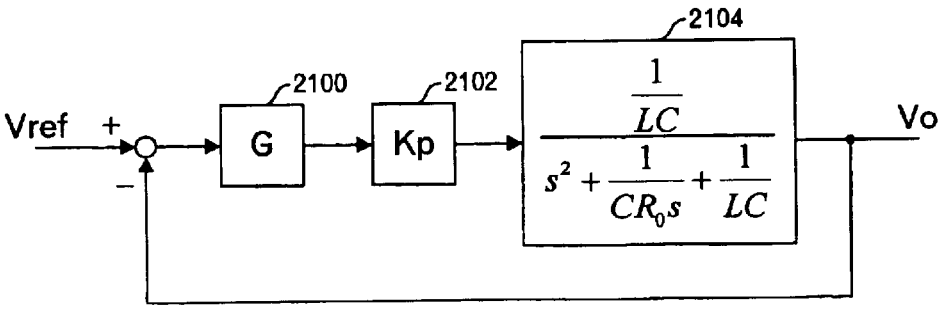
FIG. 4 is a block diagram as a premise.

In the case where the frequency characteristic as shown in FIG. 1 is realized, it is also understood from a block diagram that the input fluctuation has a large influence on the stability. FIG. 4 is a block diagram for realizing the frequency characteristic as shown in FIG. 1. An output voltage Vo is negatively fed back, and a difference (Vref−Vo) from a reference voltage (Vref) is calculated. The difference (Vref−Vo) is inputted to a transfer function G(2100) of a controller. The transfer function G(2100) will be described later in detail. The output of the transfer function G(2100) is inputted to a transfer function Kp(2102) of a power converter. The transfer function Kp(2102) is a proportional element having no frequency characteristic. Incidentally, when Vi is an input voltage of an input power supply, and Vp is a peak voltage of a triangular wave used to perform a PWM control, the relation of Kp=Vi/Vp is established. The output of the transfer function Kp(2102) is inputted to a transfer function 2104 of an LC filter, and the output of the transfer function 2104 becomes the output voltage Vo. The transfer function 2104 has a form as shown in FIG. 4 by a capacitance C of a capacitor used for the LC filter, an inductance L of a choke coil, and a resistance value Ro of a load resistance.

The case where the load fluctuation occurs means that the value of Ro in the transfer function 2104 fluctuates. When the value of Ro fluctuates, the coefficient of a linear term of a denominator in the quadratic transfer function fluctuates, so that a damping coefficient ζ fluctuates. When Ro is decreased, ζ becomes large, and therefore, a resonant characteristic becomes weak. On the other hand, when Ro is increased, ζ becomes small, and therefore, the resonant characteristic becomes strong. This is the same as that described with reference to FIG. 2. On the other hand, in the case where the input fluctuation occurs, the transfer function Kp(2102) fluctuates. As described above, because the relation of Kp=Vi/Vp is established, when the input voltage Vi is increased, the transfer function Kp(2102) is also increased, and when the input voltage Vi is decreased, the transfer function Kp(2102) is also decreased. However, because the transfer function Kp does not have the frequency characteristic, the fluctuation of Kp has an effect to shift the whole frequency characteristic in parallel, and the phase characteristic does not change.

As described above, in that the high-speed response of the power supply apparatus is ensured, it is very important to realize the frequency characteristic of the open-loop transfer function having the trap point as shown in FIG. 1. However, when such a frequency characteristic as to provide the trap point is realized, because the trap point exists, there is a serious problem in the stability with respect to the input fluctuation. Accordingly, when the frequency characteristic of the open-loop transfer function as shown in FIG. 1 is realized, it becomes especially important to take measures against the input fluctuation.

In view of the problems as described above, these embodiments provide a power supply apparatus which realizes the frequency characteristic of the open-loop transfer function as shown in FIG. 1 and can deal with the input fluctuation.

1. First Embodiment

Figure 5:
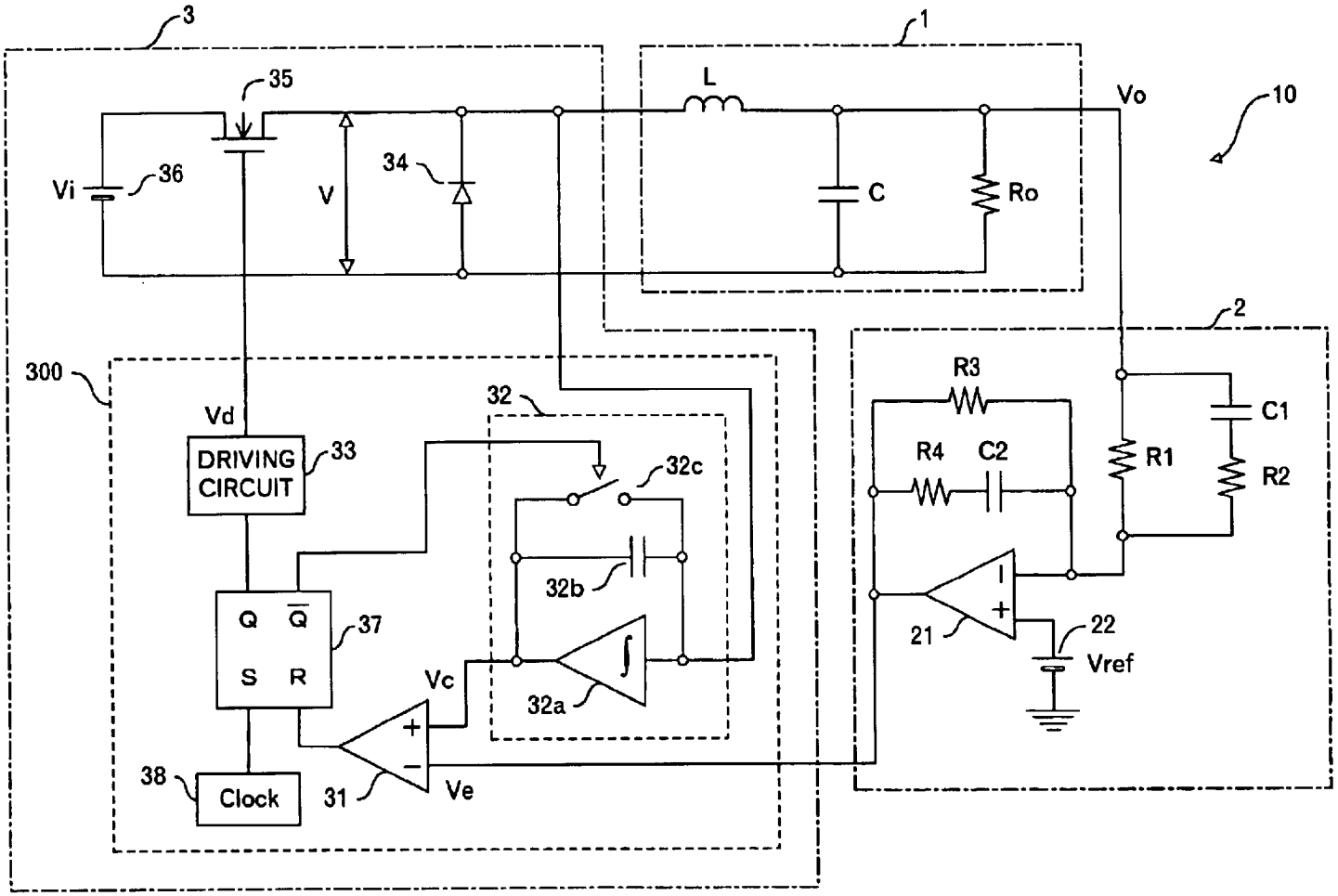
FIG. 5 is a diagram showing a circuit configuration of a power supply apparatus in a first embodiment of the invention.

FIG. 5 shows a circuit configuration of a power supply apparatus 10 according to a first embodiment of the invention. The power supply apparatus 10 is a step-down type power supply apparatus, and is composed of an LC filter 1, a controller 2 as a PID controller, and a power converter 3 including a pulse controller 300.

The controller 2 includes resistors R1 to R4, capacitors C1 and C2, an amplifier 21 and a reference voltage power supply 22. The resistor R1 and the capacitor C1 are connected to a positive side terminal of a load Ro in the LC filter 1. That is, an output voltage Vo is inputted to this controller 2. The capacitor C1 and the resistor R2 are connected in series, and the capacitor C1 and the resistor R2 are connected in parallel to the resistor R1. Accordingly, the other end of the resistor R1 whose one end is connected to the capacitor C1 is connected to the resistor R2. Besides, the resistors R1 and R2 are connected to a negative side input terminal of the amplifier 21, and are further connected to the resistor R3 and the capacitor C2. The capacitor C2 and the resistor R4 are connected in series, and the capacitor C2 and the resistor R4 are connected in parallel to the resistor R3. Accordingly, the other end of the resistor R3 whose one end is connected to the capacitor C2 is connected to the resistor R4. Besides, the resistors R3 and R4 are connected to an output terminal of the amplifier 21. A positive side input terminal of the amplifier 21 is connected to a positive side terminal of the reference voltage power supply 22, and a negative side terminal of the reference voltage power supply 22 is grounded. Incidentally, the output of the controller 2, that is, the output of the amplifier 21 is Ve.

The power converter 3 is composed of the pulse controller 300 including a comparator 31, an integrator 32, a Set Reset (SR) flip-flop (FF) 37, a clock generator 38 and a driving circuit 33, a diode 34, a MOSFET 35, and an input power supply 36. The integrator 32 includes an arithmetic unit 32*a*, a capacitor 32*b* and a switch 32*c*. A negative side terminal of the comparator 31 is connected to the output terminal of the amplifier 21. That is, the output Ve of the controller 2 is inputted to the negative side terminal of the comparator 31. An output of the arithmetic unit 32*a* is connected to a positive side terminal of the comparator 31. That is, an output Vc of the amplifier 32 is inputted to the positive side terminal of the comparator 31. An output terminal of the comparator 31 is connected to an R terminal of the SR-FF 37. The clock generator 38 is connected to an S terminal of the SR-FF 37. A Q terminal of the SR-FF 37 is connected to the driving circuit 33. An output of the driving circuit 33 is connected to a gate of the MOSFET 35. Besides, a Q inversion (Q bar) terminal of the SR-FF 37 controls the on/off of the switch 32*c*.

A drain of the MOSFET 35 is connected to a positive side terminal of the input power supply 36, and a source thereof is connected to a cathode of the diode 34 and a choke coil L. A negative side terminal of the input power supply 36 is connected to an-anode of the diode 34, a capacitor C, and a negative side terminal of the load Ro. Incidentally, the source of the MOSFET 35, the cathode of the diode 34, and the choke coil L are connected to an input terminal of the arithmetic unit 32*a*, the capacitor 32*b* and the switch 32*c*. An output terminal of the arithmetic unit 32*a* is connected to the other end of the capacitor 32*b*, the other end of the switch 32*c* and the positive side terminal of the comparator 31. Incidentally, a voltage between the cathode and the anode of the diode 34 is V.

The LC filter 1 includes the choke coil L, the capacitor C and the load Ro. The other end of the choke coil L whose one end is connected to the source of the MOSFET 35, the cathode of the diode 34 and the integrator 32 is connected to the capacitor C and the positive side terminal of the load Ro. As described above, the other end of the capacitor C whose one end is connected to the choke coil L and the positive side terminal of the load Ro is connected to the negative side terminal of the load Ro, the anode of the diode 34, and the negative side terminal of the input power supply 36.

The operation of the power supply apparatus 10 shown in FIG. 5 will be described in brief. The controller 2 generates the control signal Ve on the basis of the output voltage Vo appearing at the load Ro and the reference voltage Vref. This control signal Ve is compared in the comparator 31 with the signal Vc outputted from the integrator 32. The SR-FF 37 outputs an ON signal to the driving circuit 33 in response to the rising of the clock signal from the clock generator 38. On the other hand, the SR-FF 37 outputs a signal to turn off the switch 32*c* in response to the rising of the clock signal from the clock generator 38. When the switch 32*c* is turned off, the integrator 32 starts integration, and the integration result is outputted as the signal Vc to the comparator 31. The speed of the integration is changed in accordance with the input voltage Vi as described later in detail. When the voltage Vc becomes the voltage Ve or higher, the comparator 31 outputs a reset signal to the SR-FF 37. The SR-FF 37 outputs an OFF signal to the driving circuit 33 in response to the reset signal. Besides, the SR-FF 37 outputs a signal to turn on the switch 32*c*. When the switch 32*c* is turned on, the integrator 32 cancels the integration. The processing as stated above is repeated in accordance with the clock signal from the clock generator 38.

The driving circuit 33 turns on or off the MOSFET 35 in accordance with the ON signal or the OFF signal from the SR-FF 37. The input voltage Vi of the input power supply 36 is converted in accordance with the on and off of the MOSFET 35, is smoothed by the diode 34 and the LC filter including the choke coil L and the capacitor C, and is outputted as the output voltage Vo to the load Ro. By this operation, a stable control is performed so that the output voltage Vo becomes coincident with the reference voltage Vref.

A transfer function G of the controller 2 as shown in FIG. 5 is expressed as follows:

$$\frac{N_2 s^2 + N_1 s + N_0}{s^2 + D_1 s + D_0} \tag{1}$$

Where, $N_0$, $N_1$, $N_2$, $D_0$ and $D_1$ are coefficients, and the relation among the resistors R1 to R4 and the capacitors C1 and C2 is as follows:

$$N_0 = \frac{R3}{R1R2C1C2(R3+R4)}$$

$$N_1 = \frac{R3(R1C1+R2C1+R4C2)}{R1R2C1C2(R3+R4)}$$

$$N_2 = \frac{R3R4(R1+R2)}{R1R2(R3+R4)}$$

$$D_0 = \frac{1}{R2C1C2(R3+R4)}$$

$$D_1 = \frac{C2(R3+R4)+R2C1}{R2C1C2(R3+R4)}$$

Figures 6, 7, 8:
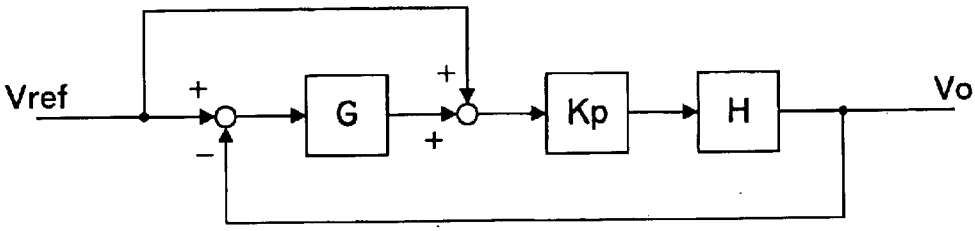
FIG. 6 is a table showing circuit constants of a controller in the first embodiment of the invention.
FIG. 7 is a table showing circuit constants of circuits 10 and 20 in the first and second embodiments of the invention.
FIG. 8 is a diagram showing a block diagram in the first, second and third embodiments of the invention.

More specifically, circuit constants as in a table of FIG. 6 are used. That is, R1=1 KΩ, R2=98 Ω, R3=710 KΩ, R4=2.2 KΩ, C1=2.2 nF, and C2=1 nF. Then, the expression (1) becomes as follows:

$$\frac{24.57s^2 + 2.134\times10^7 s + 4.624\times10^{12}}{s^2 + 4.670\times10^6 s + 6.513\times10^9} \tag{2}$$

Incidentally, it is assumed that as the specification of the power supply apparatus 10 and the other parameters, those shown in FIG. 7 are used. That is, input voltage Vi=6 V, output voltage Vo=2.5 V, output current Io=1 A (maximum), reactance L of the choke coil L is L=3 μH, capacitance C of the capacitor C is C=9.4 μF, load Ro=2.5 Ω, reference voltage Vref=2.5 V, and gain Kp of the power converter is Kp=10 times.

FIG. 8 is a block diagram showing the power supply apparatus 10 of FIG. 5. That is, the output voltage Vo is negatively fed back and is subtracted from the target voltage Vref, and (Vref−Vo) as its result is inputted to the transfer function G of the controller 2. The output of the transfer function G is added with the target voltage Vref, which acted as the feed forward, and the addition result is inputted to the transfer function Kp of the power converter 3. The output of the transfer function Kp is inputted to the transfer function H of the LC filter 1, and the output of the transfer function H becomes the output voltage Vo. The transfer function G has the form of the expression (1) described above. In this embodiment, a description will be given on the assumption that the product of the transfer function Kp and the transfer function H as control targets has a form as indicated below.

$$\frac{\frac{1}{LC}Kp}{s^2 + \frac{1}{CRo}s + \frac{1}{LC}} \tag{3}$$

This is the transfer function in which the LC filter 1 and the power converter 3 are combined. When the numerical values shown in FIG. 7 are substituted, the following is obtained.

$$\frac{3.546\times10^{11}}{s^2 + 4.255\times10^4 s + 3.546\times10^{10}} \tag{4}$$

The open-loop transfer function becomes the product of the expression (1) and the expression (3). More specifically, it becomes the product of the expression (2) and the expression (4).

Figure 9:
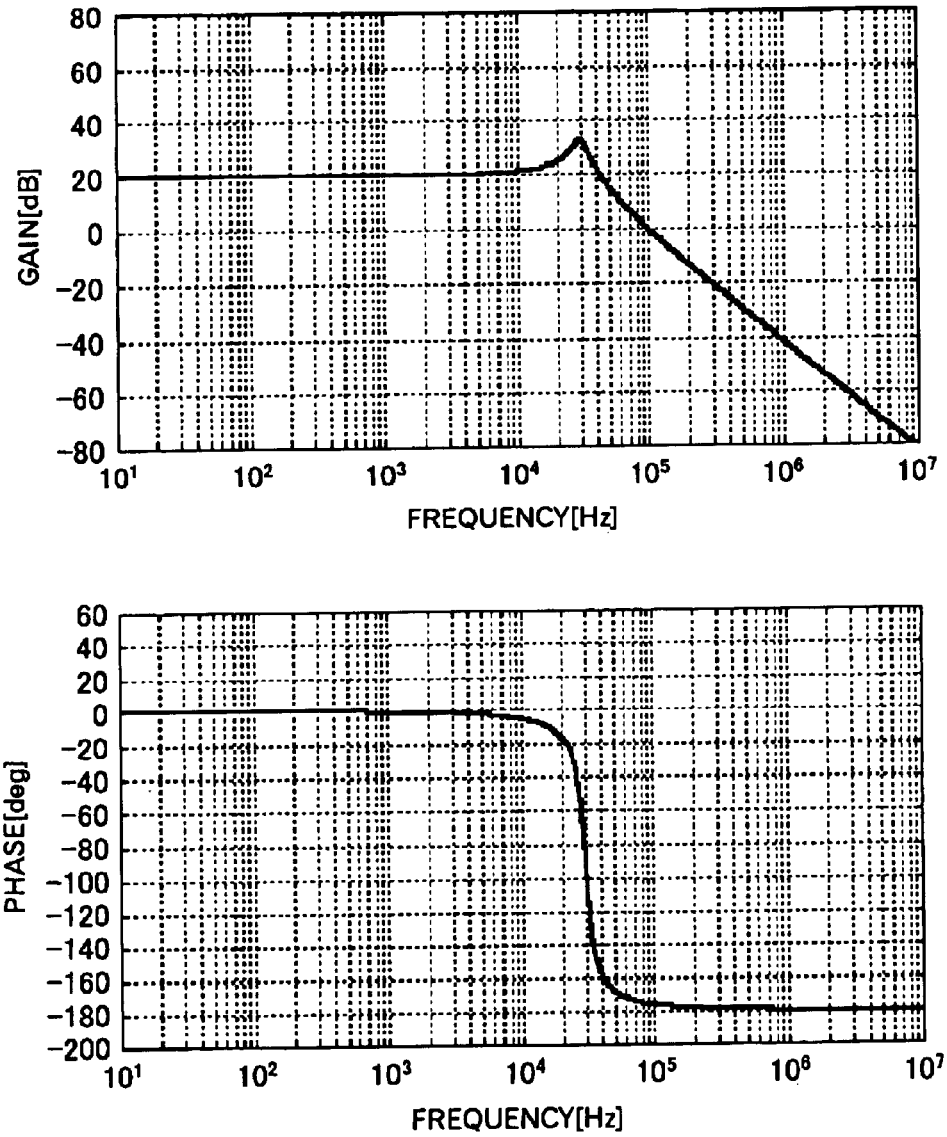
FIG. 9 is a Bode diagram of a transfer function of an LC filter and a power converter as control targets in the first embodiment of the invention.
Figure 10:
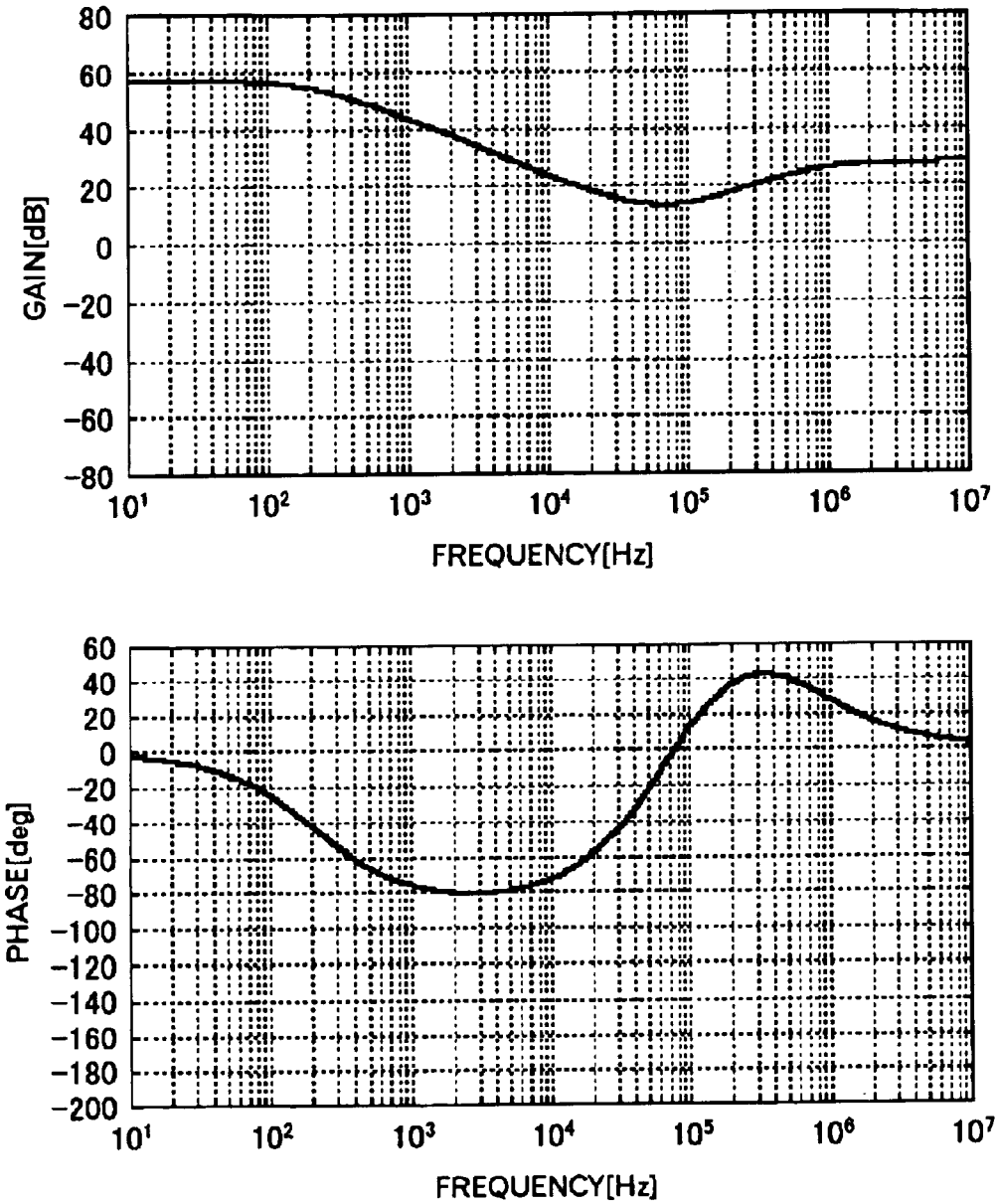
FIG. 10 is a Bode diagram of a transfer function of the controller in the first embodiment of the invention.

FIG. 9 is a Bode diagram of a control target based on the expression (4). In FIG. 9, the upper diagram shows a frequency characteristic of a gain, and the lower diagram shows a frequency characteristic of a phase. In FIG. 9, the resonant frequency of the LC filter 1 is approximately $3\times10^4$ Hz. Then, the peak of the gain exists at the resonant frequency, and the phase starts to delay before the resonant frequency, rapidly delays at the resonant frequency, and finally delays by 180 degrees. FIG. 10 is a Bode diagram of the controller 2 on the basis of the expression (2). Also in FIG. 10, the upper diagram shows a frequency characteristic of a gain, and the lower diagram shows a frequency characteristic of a phase. In FIG. 10, although the gain is 57 dB and is flat until approximately $5\times10^1$ Hz, it is almost linearly decreased from approximately $5\times10^1$ Hz to approximately $7\times10^4$ Hz. In a frequency range higher than that, the gain is slightly increased. With respect to the phase, a phase delay of approximately −80 degrees occurs until approximately $2\times10^3$ Hz, and in a frequency range higher than that to approximately $3\times10^5$ Hz, the phase advances to +40 degrees. In a further high frequency range, the phase delay to approximately 0 degree again occurs.

Figure 11:
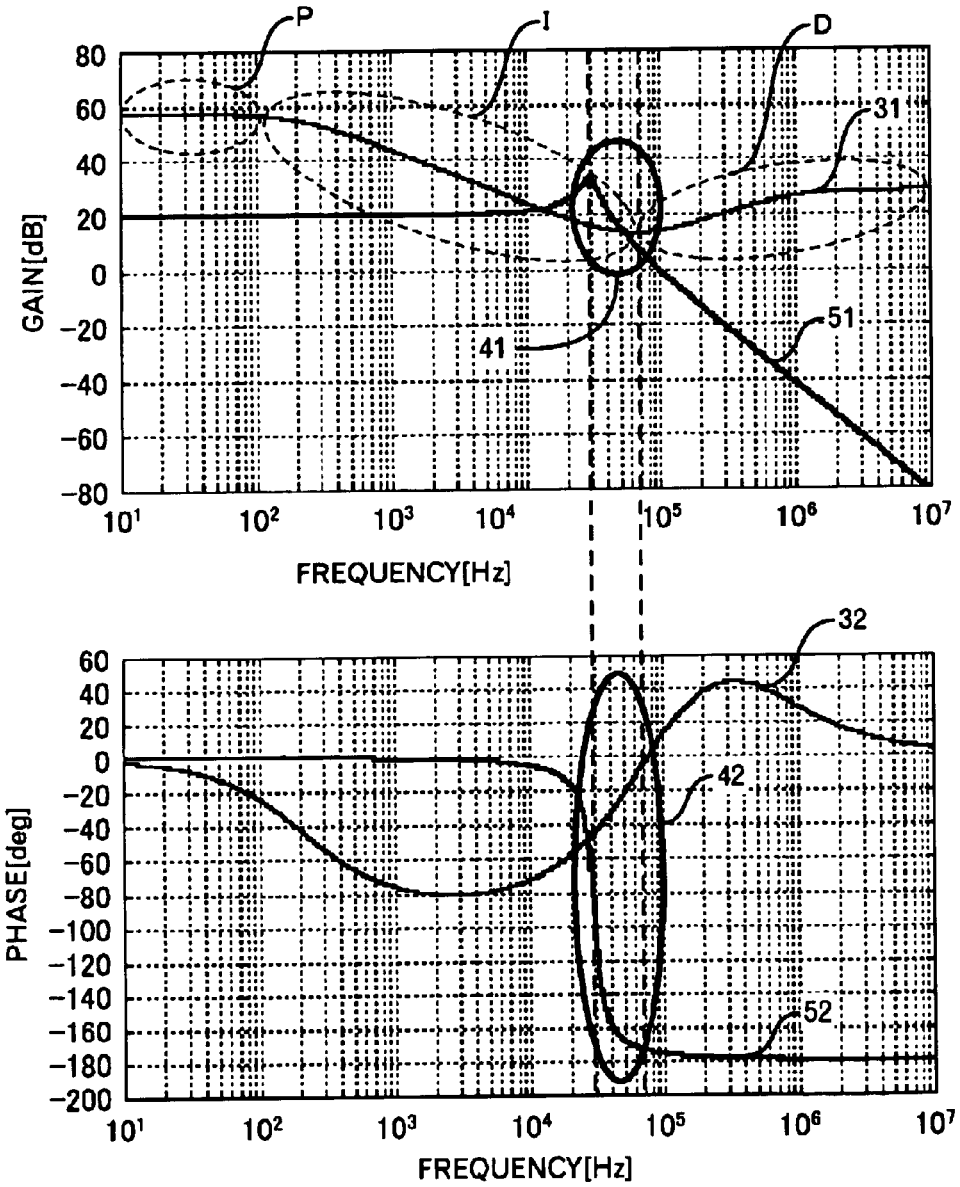
FIG. 11 is a diagram in which the Bode diagram of the transfer function of the LC filter and the power converter as the control targets in the first embodiment of the invention and the Bode diagram of the transfer function of the controller are overlapped with each other.

FIG. 11 is a Bode diagram in which FIG. 9 and FIG. 10 are overlapped with each other. Its upper diagram shows a frequency characteristic of a gain, a curve 51 indicates the gain frequency characteristic of the expression (5), and a curve 31 indicates the gain frequency characteristic of the expression (3). This embodiment is characterized in that until a frequency range higher than the resonant frequency of the LC filter 1, an integration (I) element added from a low frequency range is used in order to eliminate a steady-state deviation. In FIG. 11, it is a portion 41 indicated by a solid line. Besides, the lower diagram of FIG. 11 shows a frequency characteristic of a phase, a curve 52 indicates the phase frequency characteristic of the expression (5), and a curve 32 indicates the phase frequency characteristic of the expression (3). A portion 42 indicated by a solid line corresponds to the portion 41 in the gain frequency characteristic, and when the curve 52 and the curve 32 are added to obtain a phase frequency characteristic of an open-loop transfer function, a frequency range (trap point) in which the phase is most delayed is created. Incidentally, a differentiation (D) control element of the PID control element is applied from a frequency lower than the gain crossover frequency.

Figure 12:
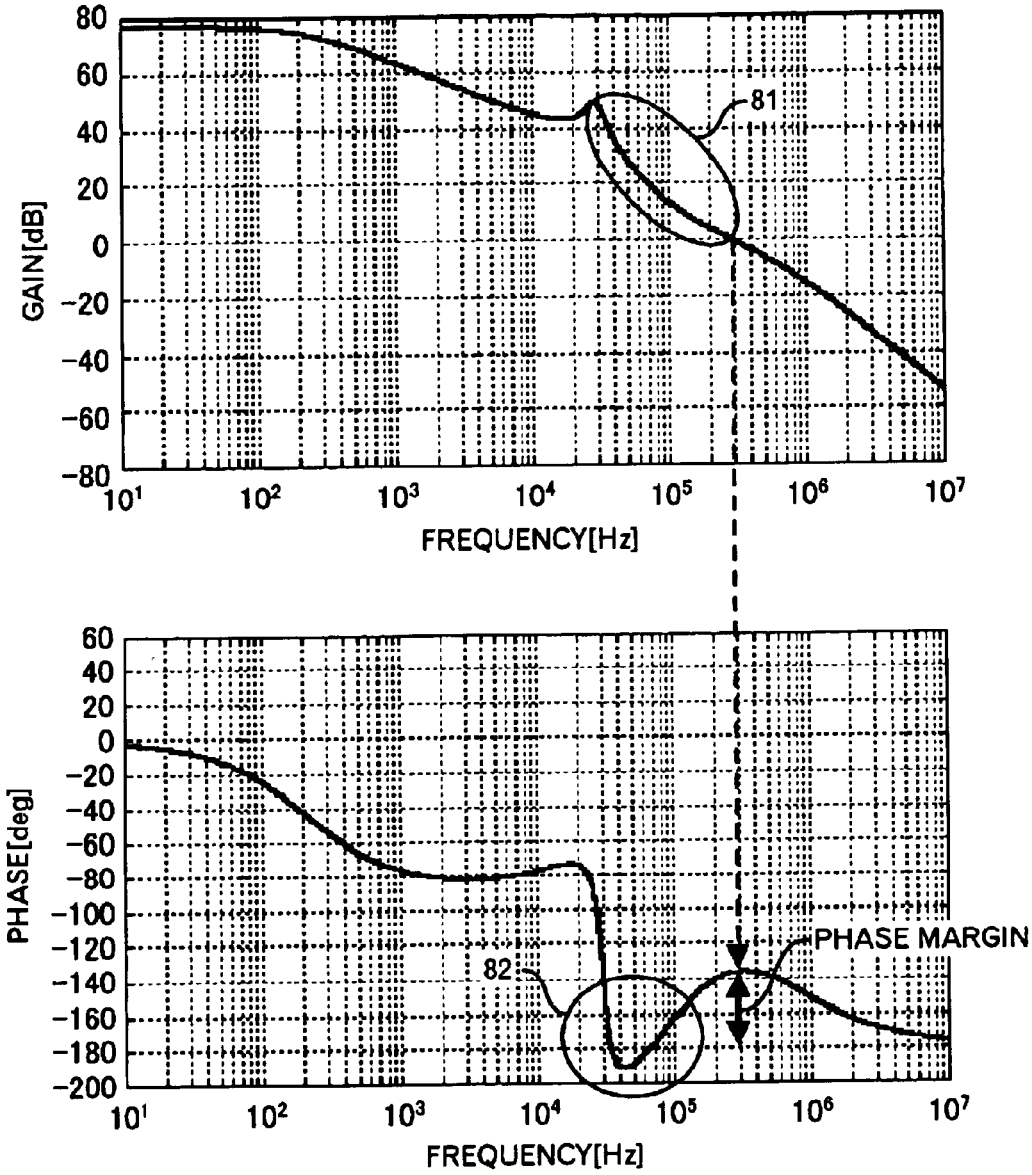
FIG. 12 is a Bode diagram of an open-loop transfer function in the first embodiment of the invention.

FIG. 12 is a Bode diagram of an open-loop transfer function. Its upper diagram shows the gain frequency characteristic of the open-loop transfer function in which the-gain characteristics of FIGS. 9 and 10 are combined, and its lower diagram shows the phase frequency characteristic of the open-loop transfer function in which the phase frequency characteristics of FIGS. 9 and 10 are combined. As shown in FIG. 11, the integration (I) element of the PID is applied until the frequency range higher than the resonant frequency of the LC filter 1, so that a portion 81 in which the inclination of the gain frequency characteristic becomes large is created. Besides, a trap point 82 including a frequency at which the phase is most delayed is also created in the same frequency range as the portion 81. In this frequency range, the phase becomes −180 degrees or less, and the gain exceeds 0 dB. That is, there is no gain margin. Although it is not permitted from the conventional concept of stability, in this embodiment, even if there is no gain margin, the operation is stably performed, and therefore, there is no problem. On the other hand, a phase margin from −180 degrees at the gain crossover frequency at which the gain becomes 0 dB is approximately 45 degrees and the sufficient phase margin is ensured, and the stable operation is ensured by this. Incidentally, because the trap point 82 is created by using the characteristic that the phase is delayed by −180 degrees at the resonant frequency of the LC filter 1 and by using the integration (I) control element until the frequency range higher than the resonant frequency of the LC filter 1, the frequency at which the phase is most delayed becomes a frequency higher than the resonant frequency of the LC filter 1. On the other hand, the phase advances at the frequency higher than the trap point 82 and becomes almost maximum at the gain crossover frequency. Accordingly, the gain crossover frequency becomes a frequency higher than the frequency at which the phase is most delayed.

Thus, when the frequency range in which the phase is abruptly delayed is created, the gain is abruptly decreased in the frequency range as shown in the portion 81 of FIG. 12. By the achievement of the high inclination of the gain, a high gain is realized even in a limited frequency range, and consequently, a mechanism to enable high speed response also at the time of a load abrupt change or the like can be achieved.

Besides, the number of the resistors used in the controller 2 is four, and the number of the capacitors is two. Although described later, the number of the resistors may be three, and there is a merit that the number of parameters to be decided to construct a circuit for realizing the frequency characteristics of the gain and the phase as described above is relatively small, and the design is easy to make.

Figure 13:
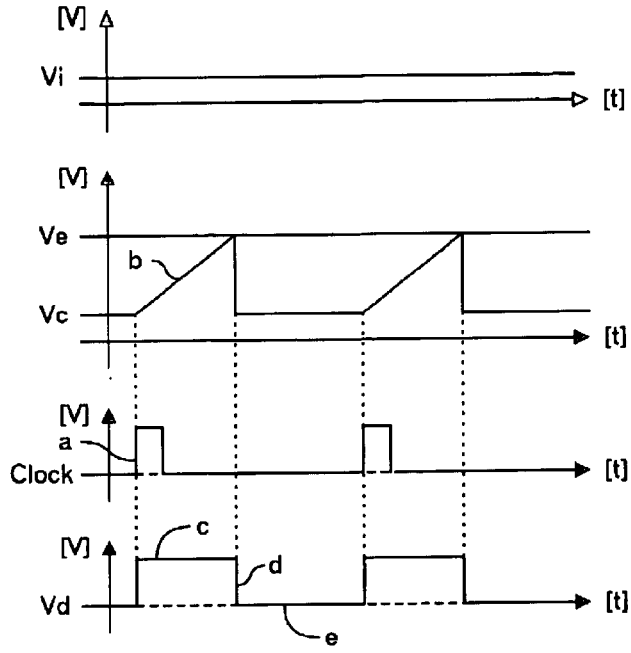
FIG. 13 is a waveform diagram to explain an operation of the power converter.

Next, the detailed operation of the power converter 3 in a steady state will be described with reference to FIG. 13. Incidentally, the vertical axis indicates voltage [V], and the horizontal axis indicates time [t]. First, in response to the rising of the clock signal generated by the clock generator 38 (See "a"), the output Vd of the Q terminal of the SR-FF 37 is turned on. At the same time as the turning on of the output Vd of the Q terminal of the SR-FF 37, the output of the Q inversion terminal is turned off, and therefore, the switch 32*c* of the integrator 32 is turned off, and the integration operation of the input voltage V to the LC filter 1 is started in the integrator 32 (See "b"). The output Vc of the integrator 32 and the output Ve of the controller 2 are compared with each other by the comparator 31, and when the voltage Vc is lower than the voltage Ve, the output of the comparator 31 remains OFF (low), and the input to the R terminal of the SR-FF 37 remains OFF, and therefore, the output Vd of the Q terminal remains ON (See "c"). When the voltage Vc becomes the voltage Ve or higher, because the output of the comparator 31 becomes ON (high), the input to the R terminal of the SR-FF 37 becomes ON, and the output Vd of the Q terminal becomes OFF (See "d"). On the other hand, because the output of the Q inversion terminal becomes ON, the switch 32*c* of the integrator 32 is turned ON, and the voltage of the output Vc of the integrator 32 is returned to the initial state. Incidentally, the output Vd of the Q terminal of the SR-FF 37 remains OFF again until the rising of the clock signal generated by the clock generator 3 (See "e"). The above-mentioned operation is repeated. Incidentally, the input of the integrator 32 is the voltage of the source of the MOSFET 35 during the output of the ON signal by the driving circuit 33 to the MOSFET 35, and is basically the input voltage Vi of the input power supply 36. Accordingly, a rise in the voltage of the output Vc as the result of integration of the integrator 32 becomes rapid when the input voltage Vi rises, and becomes slow when falls.

Figure 14:
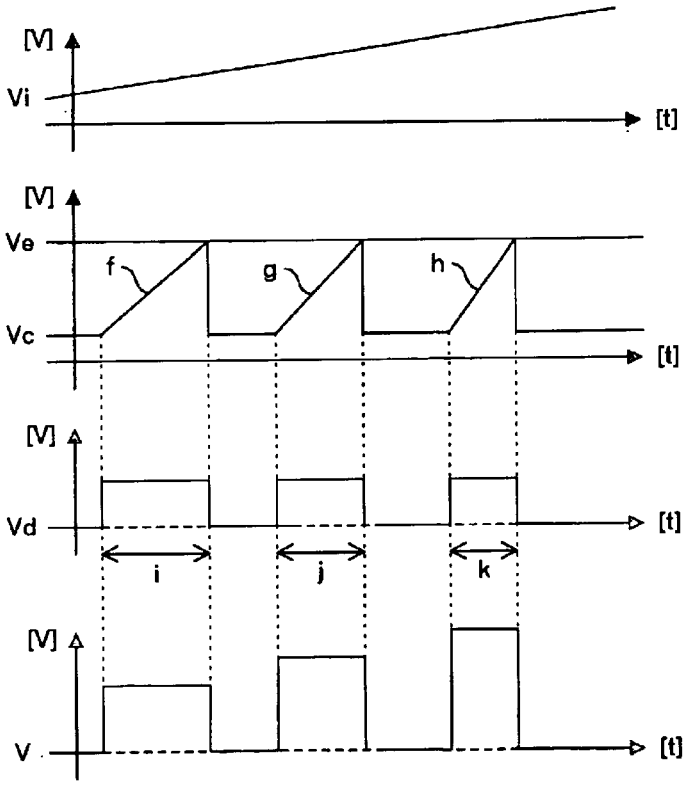
FIG. 14 is a waveform diagram to explain the operation of the power converter.

Besides, the operation in the case where the input fluctuation occurs will be described with reference to FIG. 14. Incidentally, the vertical axis indicates voltage [V], and the horizontal axis indicates time [t]. As shown in the first column of FIG. 14, when the input voltage Vi of the input power supply 36 gradually rises, a rise in the voltage of the output Vc of the integrator 32 becomes rapid. That is, the inclination of the output Vc of the integrator 32 becomes steep like f, g and h as the input voltage Vi rises as shown in the second column of FIG. 14. Then, the time until the voltage of the output Vc reaches the output Ve of the controller 2 becomes short as indicated by pulse widths i, j and k of the output Vd of the Q terminal of the SR-FF 37 as shown in the third column of FIG. 14. As a result, the input V to the LC filter 1 has the pulse width of the output Vd of the Q terminal of the SR-FF 37 as shown in the last column of FIG. 14, and becomes a signal having the same voltage as the input voltage Vi. That is, in the case of the low voltage Vi, the pulse width becomes long, and in the case of the high voltage Vi, the pulse width becomes short. More specifically, the control is carried out so that the multiplying of Vi and the pulse width becomes the same (the multiplying of VT is constant or the multiplying of ET is constant). Thus, even if the output Ve of the controller 2 is not changed, the output voltage Vo is controlled to be constant, and as a result, the gain fluctuation of the controller 2 due to the input fluctuation is suppressed.

Figures 15, 17:
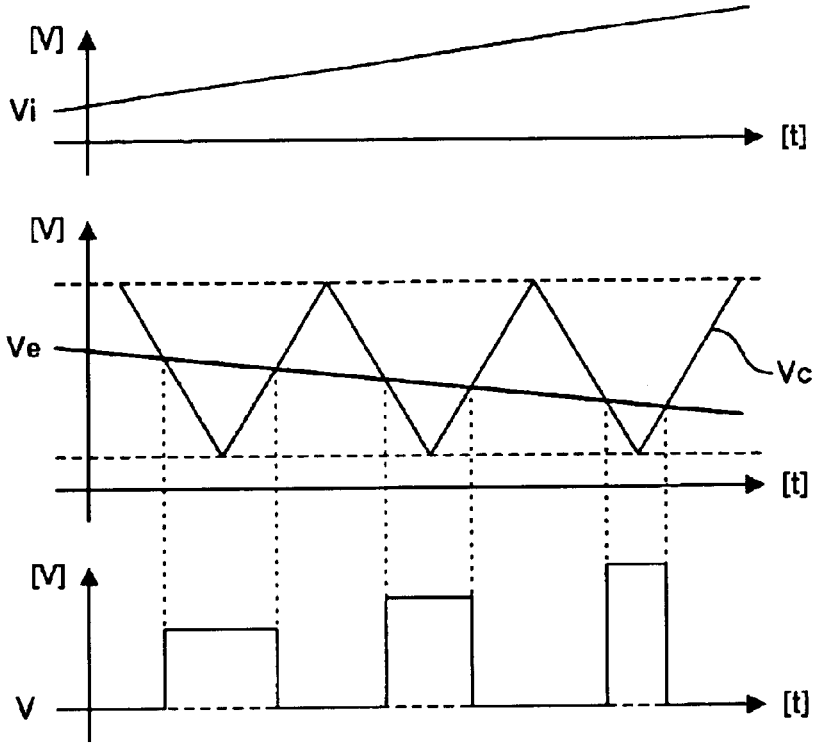
FIG. 15 is a waveform diagram to explain an operation of a conventional power converter.
FIG. 17 is a table showing circuit constants of a controller in the second embodiment of the invention.

Incidentally, in the conventional power converter in which the output Ve of the controller 2 is compared with the output Vc of the triangular wave generator by a PWM comparator and the MOSFET is turned on or off through the driving circuit when the voltage of the output Vc of the triangular wave generator becomes the voltage of the output Ve or less of the controller, as shown in FIG. 15, because the voltage of the output Ve of the controller becomes low when the input voltage Vi rises, the pulse width of the output pulse of the PWM comparator becomes narrow, and the pulse width of the input V to the LC filter 2 also becomes narrow. Incidentally, the height (voltage) of the input V is the same as the input voltage Vi. However, because the input fluctuation has an influence on the controller 2, the problem shown in FIG. 3 arises.

As stated above, according to this embodiment, the fluctuation in the frequency characteristic of the gain caused by the input fluctuation as shown in FIG. 3 can be avoided, and the problem of the stability to the input fluctuation is solved. Although described above, in the case where the frequency characteristic of the open-loop transfer function as shown in FIG. 1 is realized, because the trap point having a large contribution toward the high speed response has conversely an influence as weakness on the input fluctuation, the configuration of the power converter 3 in this embodiment is very important as a countermeasure to that weakness.

2. Second Embodiment

Figure 16:
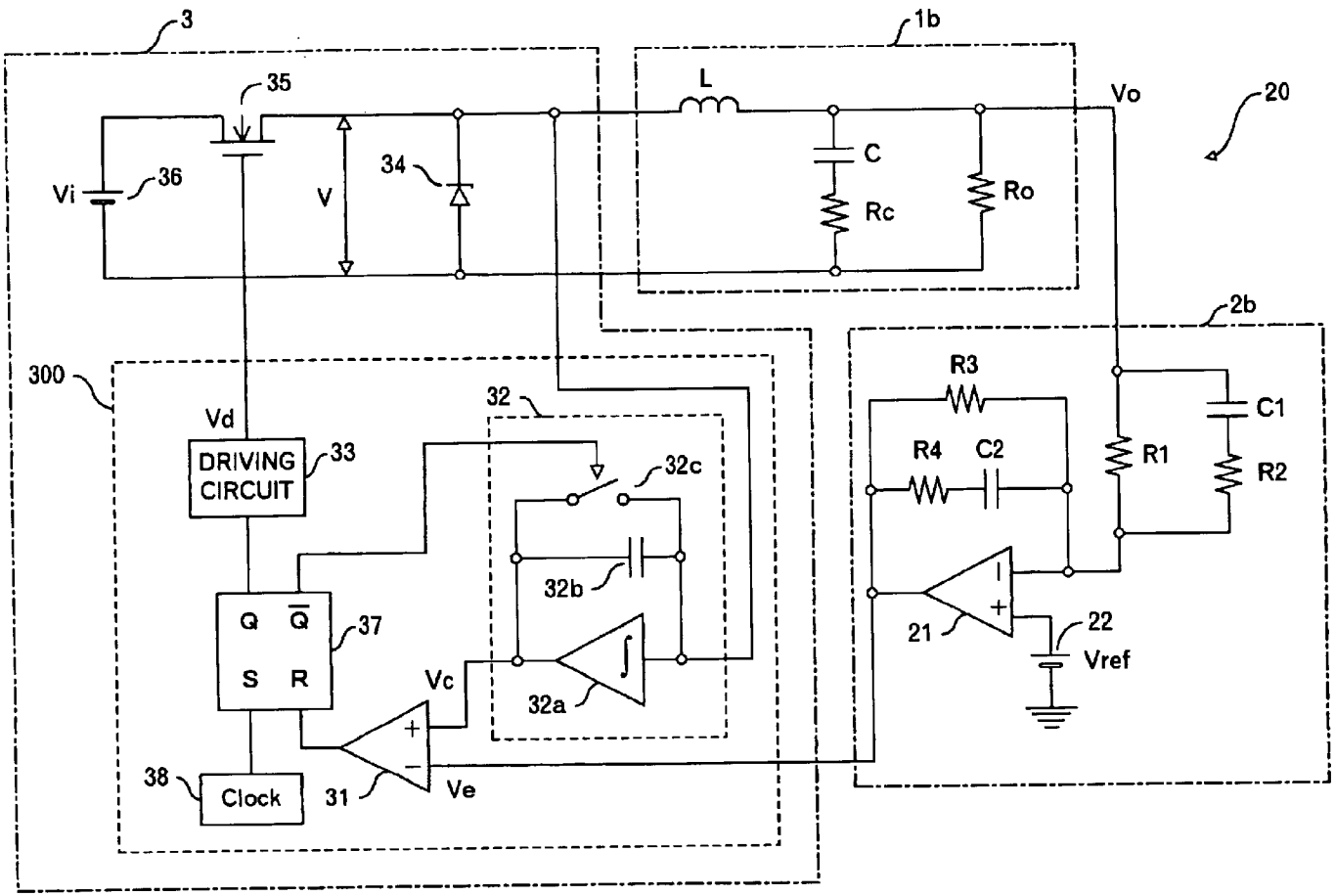
FIG. 16 is a diagram showing a circuit configuration of a power supply apparatus in the second embodiment of the invention.

FIG. 16 shows a circuit configuration of a power supply apparatus 20 of this embodiment. A difference from the power supply apparatus 10 shown in FIG. 5 is that a resistor Rc is connected in series to a capacitor C of an LC filter 1*b*, and circuit constants of resistors and capacitors of a controller 2*b* are changed as shown in FIG. 17. Accordingly, the connection relation will not be described here. Incidentally, the resistor Rc is called an equivalent series resistance and indicates a resistance component included in the capacitor C. Accordingly, Rc is approximately 2 mΩ. Although described later, the resistor Rc acts as phase-lead compensation in a high frequency range. The circuit constants of the resistors and the capacitors of the controller 2*b* are, as shown in FIG. 17, R1=1 KΩ, R2=60 Ω, R3=430 KΩ, R4=1.4 KΩ, C1=3.3 nF, and C2=1.8 nF.

When a transfer function of the controller 2*b* is calculated, an expression as indicated below is obtained.

$$\frac{24.65s^2 + 1.683\times10^7 s + 2.797\times10^{12}}{s^2 + 5.052\times10^6 s + 6.504\times10^9} \tag{5}$$

On the other hand, when a transfer function of a control target in which the LC filter 1*b* and the power converter 3 are combined is calculated, an expression as indicated below is obtained.

$$\frac{\frac{RcRo}{L(Rc+Ro)}Kp\,s + \frac{Ro}{LC(Rc+Ro)}Kp}{s^2 + \left\{\frac{1}{C(Rc+Ro)} + \frac{RcRo}{L(Rc+Ro)}\right\}s + \frac{Ro}{LC(Rc+Ro)}} \tag{6}$$

$$\frac{6661.3s + 3.543\times10^{11}}{s^2 + 4.32\times10^4 s + 3.54\times10^{10}} \tag{7}$$

Figure 18:
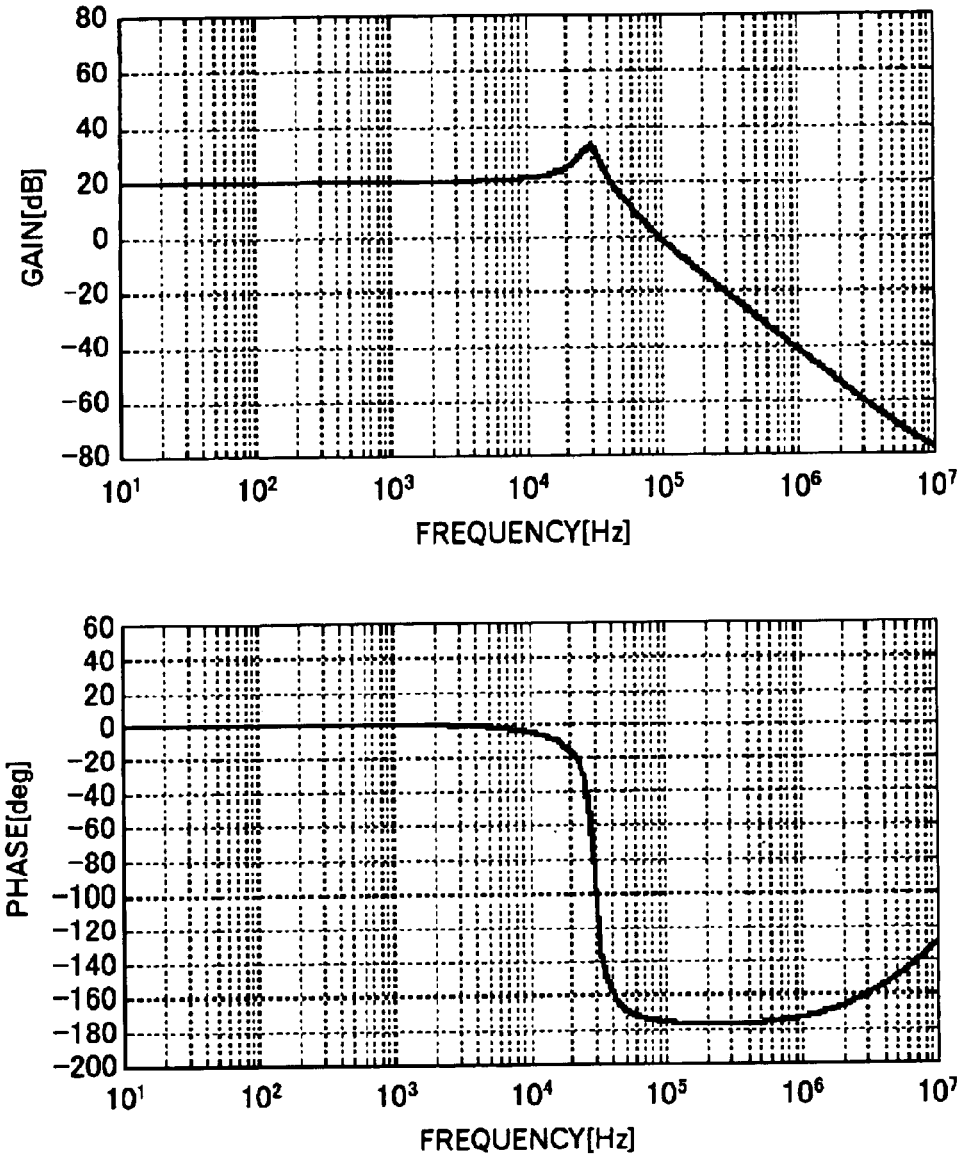
FIG. 18 is a Bode diagram of a transfer function of an LC filter and a power converter as control targets of the second embodiment of the invention.
Figure 19:
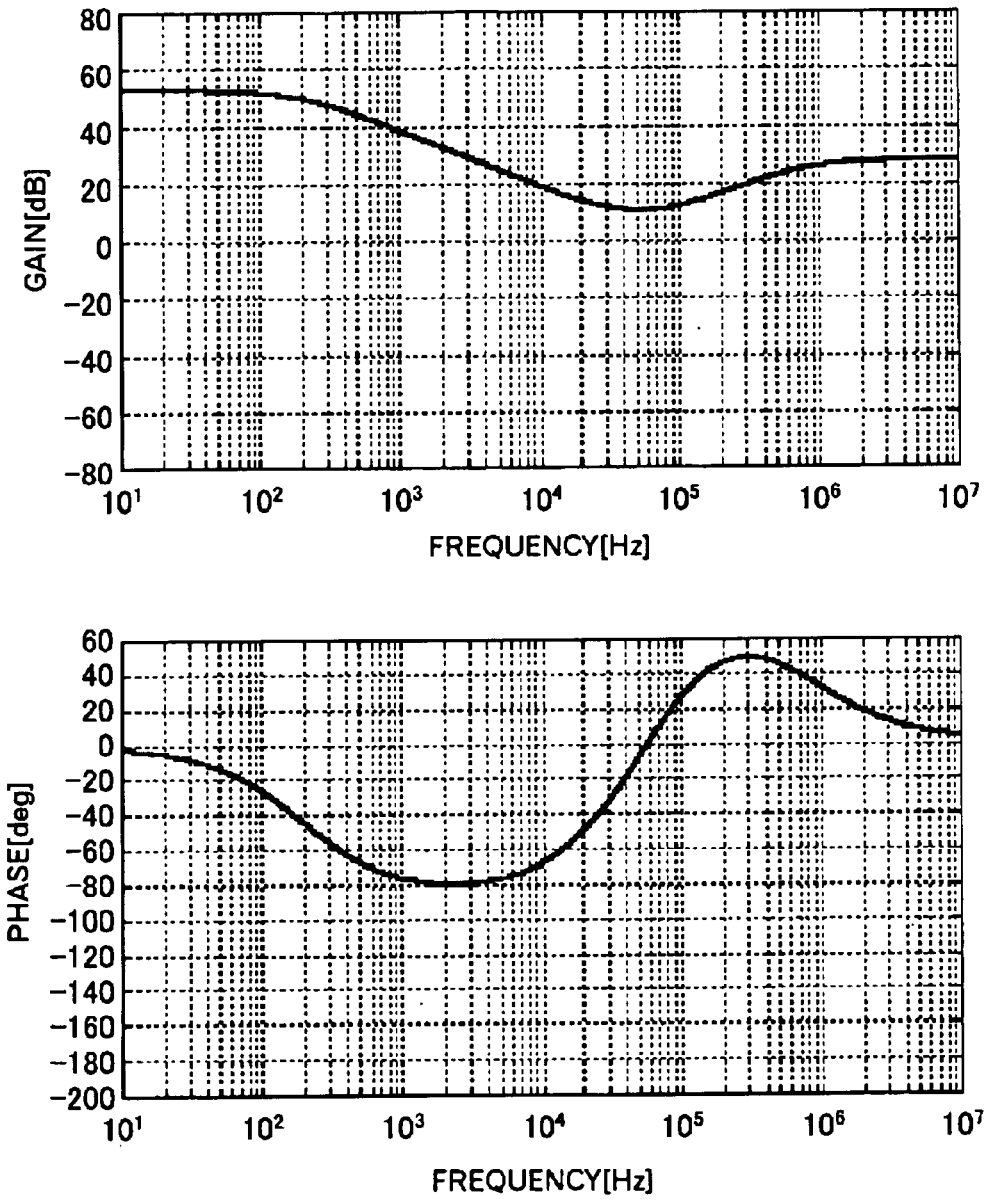
FIG. 19 is a Bode diagram of a transfer function of a controller in the second embodiment of the invention.

FIG. 18 is a Bode diagram of the transfer function of the expression (7). A frequency characteristic of a gain shown in the upper diagram of FIG. 18 is not much different from the gain frequency characteristic of FIG. 9. With respect to a frequency characteristic of a phase shown in the lower diagram of FIG. 18, as described above, because the resistor Rc acts as the phase-lead compensation in the high frequency range, the phase starts to gradually advance from approximately $4\times10^5$ Hz. On the other hand, FIG. 19 is a Bode diagram of the transfer function of the expression (5). As compared with FIG. 10, the gain in a low frequency range is decreased, and the shape of the curve of the phase is slightly different, however, almost the same frequency characteristic is expressed.

Figure 20:
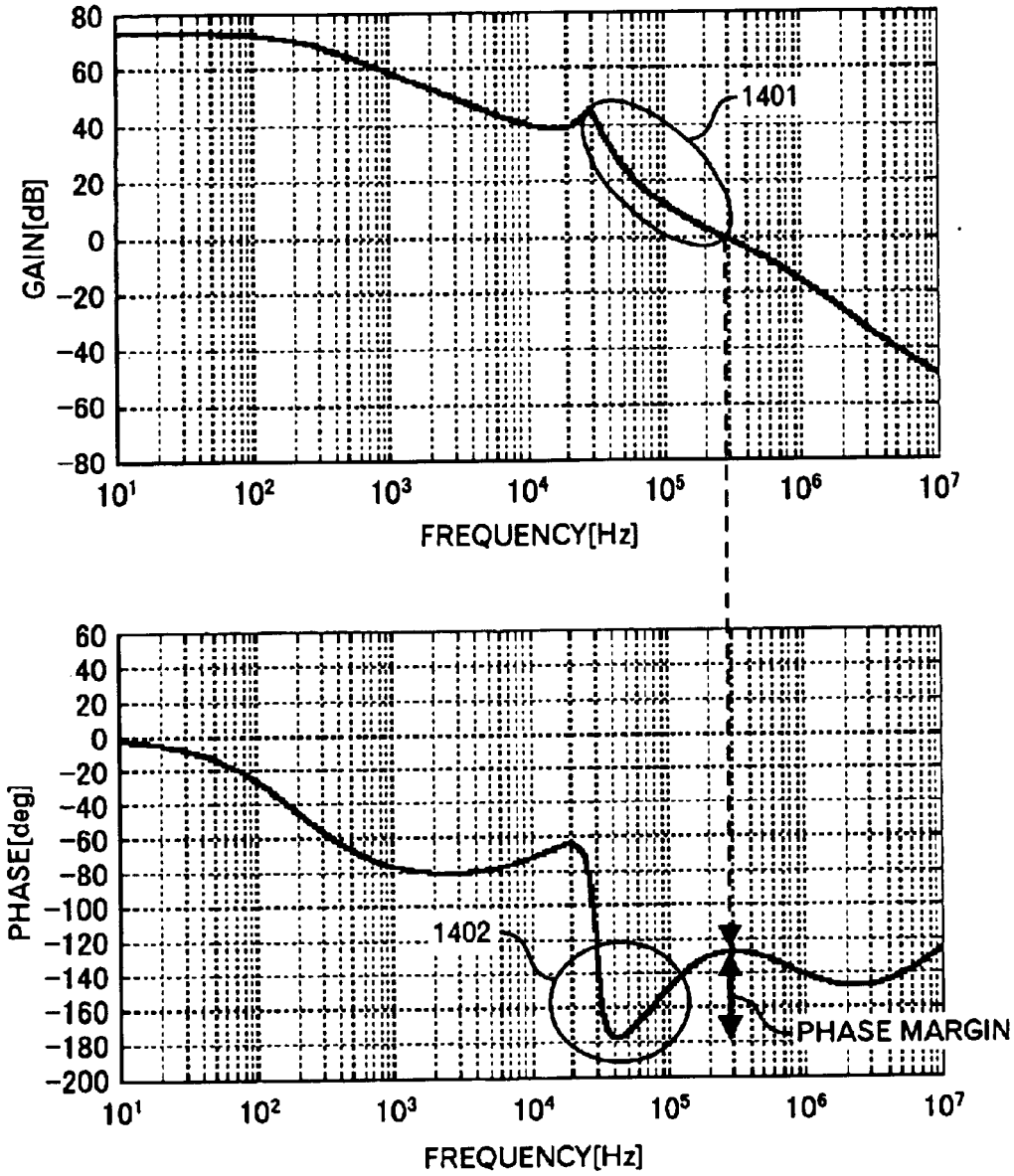
FIG. 20 is a Bode diagram of an open-loop transfer function in the second embodiment of the invention.

FIG. 20 is a Bode diagram of an open-loop transfer function in which the transfer function of the expression (5) and the transfer function of the expression (7) are multiplied together. In the frequency characteristic of the gain of the upper diagram of FIG. 20, a portion 1401 of a frequency range in which the gain is rapidly decreased is provided similarly to FIG. 12. Besides, in the frequency characteristic of the phase of the lower diagram of FIG. 20, similarly to FIG. 12, a trap point 1402 including a frequency at which the phase is most delayed is provided in a frequency range higher than the resonant frequency of the LC filter 1*b*. However, in FIG. 12, although the frequency at which the phase is most delayed becomes lower than −180 degrees, in FIG. 20, it does not reach −180 degrees. This is because the open-loop transfer function shown in FIG. 20 is calculated by multiplying the transfer function of the expression (5) and the transfer function of the expression (7) together, and when all delay elements of the power supply apparatus 20 are considered, there is possibility that a frequency at which the phase becomes lower than −180 degrees exists.

At the trap point 1402, the gain exceeds 0 dB, and because the phase does not become lower than −180 degrees at any frequencies higher than the trap point 1402, a gain margin is not ensured. At frequencies higher than the frequency at which the phase is most delayed, the phase once advances by the differentiation (D) element of the PID, and a phase margin of approximately 50 degrees is ensured at the gain crossover frequency at which the gain becomes 0 dB. At frequencies higher than the gain crossover frequency, although the phase is again delayed according to the transfer function of the controller 2*b*, because the phase-lead compensation of the resistor Rc acts, it starts to advance from approximately $2\times10^6$ Hz.

Thus, also in this embodiment, similarly to the first embodiment, because the integration (I) element of the PID is applied to the frequency range higher than the resonant frequency of the LC filter 1*b*, the trap point 1402 is created. At this trap point 1402, the state is such that the gain exceeds 0 dB, and the inclination of the gain curve is further made steep, and therefore, high-speed response is realized. Besides, because the phase margin is ensured at the gain crossover frequency, even if there is no gain margin, there is no problem in stability. When the controller 2*b* is designed so that the frequency characteristics of the phase and the gain as shown in FIG. 20 are realized, as compared with the background art, while the stability is kept, the high-speed response can be improved. Incidentally, because the number of circuit constants to be decided is not large, there is a merit that the design is easy to make.

Incidentally, the operation of the power converter 3 is the same as the first embodiment, and even if a fluctuation occurs in the input voltage Vi, because the operation is performed so that the multiplying of the output voltage to the LC filter 1*b* and the ON time becomes constant, the frequency characteristic of the open-loop transfer function calculated from the transfer functions of the LC filter 1*b*, the controller 2*b* and the power converter 3 is not influenced by the input fluctuation.

3. Third Embodiment

Figures 21, 22:
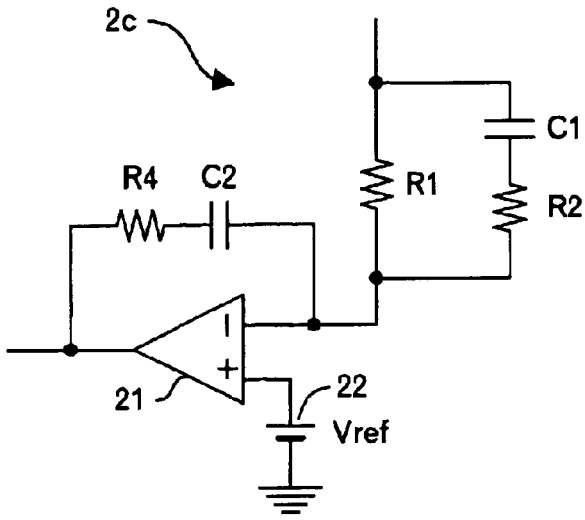
FIG. 21 is a diagram showing an example of a circuit configuration of a controller in the third embodiment of the invention.
FIG. 22 is a table showing circuit constants in the third embodiment of the invention.

In the first and second embodiments, although the circuit constants are different from each other, the controller 2 and the controller 2*b* are equal to each other in the number of resistors and capacitors and the connection relation. In the third embodiment, a circuit as shown in FIG. 21 is adopted for a controller 2.

That is, the circuit is such that the resistor R3 in the controller 2 or the controller 2*b* shown in FIG. 5 is removed. More specifically, a controller 2*c* includes resistors R1, R2 and R4, capacitors C1 and C2, an amplifier 21, and a reference voltage power supply 22. The resistor R1 and the capacitor C1 are connected to the positive side terminal of the load Ro in the LC filter 1. The capacitor C1 and the resistor R2 are connected in series, and the capacitor C1 and the resistor R2 are connected in parallel to the resistor R1. Accordingly, the other end of the resistor R1 whose one end is connected to the capacitor C1 is connected to the resistor R2. The resistors R1 and R2 are connected to a negative side input terminal of the amplifier 21, and are further connected to the capacitor C2. The capacitor C2 and the resistor R4 are connected in series. Besides, the resistor R4 is connected to an output terminal of the amplifier 21. A positive side input terminal of the amplifier 21 is connected to a positive side terminal of the reference voltage power supply 22, and a negative side terminal of the reference voltage power supply 22 is grounded. The output of the amplifier 21 is connected to the negative side input terminal of the comparator 31.

A transfer function of the controller 2*c* as stated above is basically as indicated by the expression (2), and $N_0$, $N_1$, $N_2$, $D_0$ and $D_1$ are expressed by the resistors $R_1$, $R_2$ and $R_4$ and the capacitors $C_1$ and $C_2$ as follows:

$$N_0 = \frac{1}{R1R2C1C2}$$

$$N_1 = \frac{R1C1 + R2C1 + R4C2}{R1R2C1C2}$$

$$N_2 = \frac{R4(R1 + R2)}{R1R2}$$

$$D_0 = 0$$

$$D_1 = \frac{1}{R2C1}$$

Besides, circuit constants and the like are set as shown in FIG. 22. That is, input voltage Vi=8.0 V, output voltage Vo=2.5 V, inductance L of the choke coil L is L=3 $\mu$H, capacitance C of the capacitor C is C=9.4 $\mu$F, load resistance Ro=2.5 Ω, gain Kp of the power converter 3 is Kp=22 dB, R1=10 KΩ, R2=940 Ω, R4=14 KΩ, C1=230 pF, and C2=200 pF.

When the open-loop transfer function is calculated from the circuit constants of FIG. 22, $N_0$, $N_1$, $N_2$, $D_0$ and $D_1$, and the expressions (3) and (1), the following is obtained. Where, $D_0$ is 0.

$$\frac{16.29s^2 + 1.229\times10^7 s + 2.313\times10^{12}}{s^2 + 4.625\times10^6 s} \quad (8)$$

Figure 23:
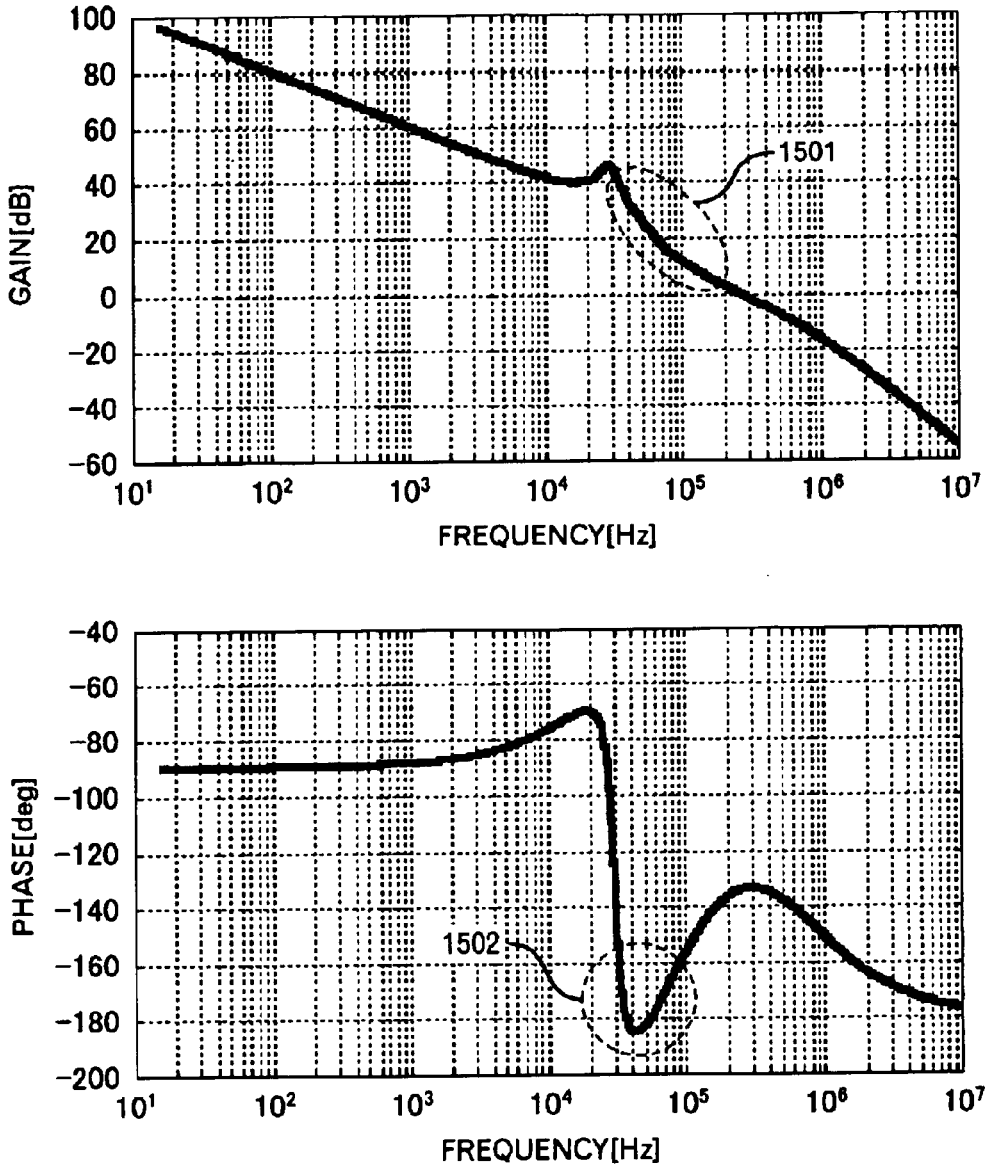
FIG. 23 is a Bode diagram of an open-loop transfer function in the third embodiment of the invention.

FIG. 23 is a Bode diagram expressing this open-loop transfer function (8). In a frequency characteristic of a gain in the upper diagram of FIG. 20, a portion 1501 of a frequency range in which the gain is abruptly decreased is provided similarly to FIG. 12. Besides, in a frequency characteristic of a phase in the lower diagram of FIG. 23, similarly to FIG. 12, a trap point 1502 including a frequency at which the phase is most delayed is provided in a frequency range higher than the resonant frequency of the LC filter 1.

The gain exceeds 0 dB at the trap point 1502, and because the phase does not become lower than −180 degrees at any frequencies higher than the trap point 1502, the gain margin is not ensured. At frequencies higher than the frequency at which the phase is most delayed, the phase once advances by the differentiation (D) element of the PID, and the phase margin of approximately 50 degrees is ensured at the gain crossover frequency at which the gain becomes 0 dB. At frequencies higher than the gain crossover frequency, the phase is again delayed according to the transfer function of the controller 2*c*.

Although described above, the power converter 3 operates independently of the controller 2*c*, and the content of the operation is the same as that explained in the first embodiment.

Figure 24:
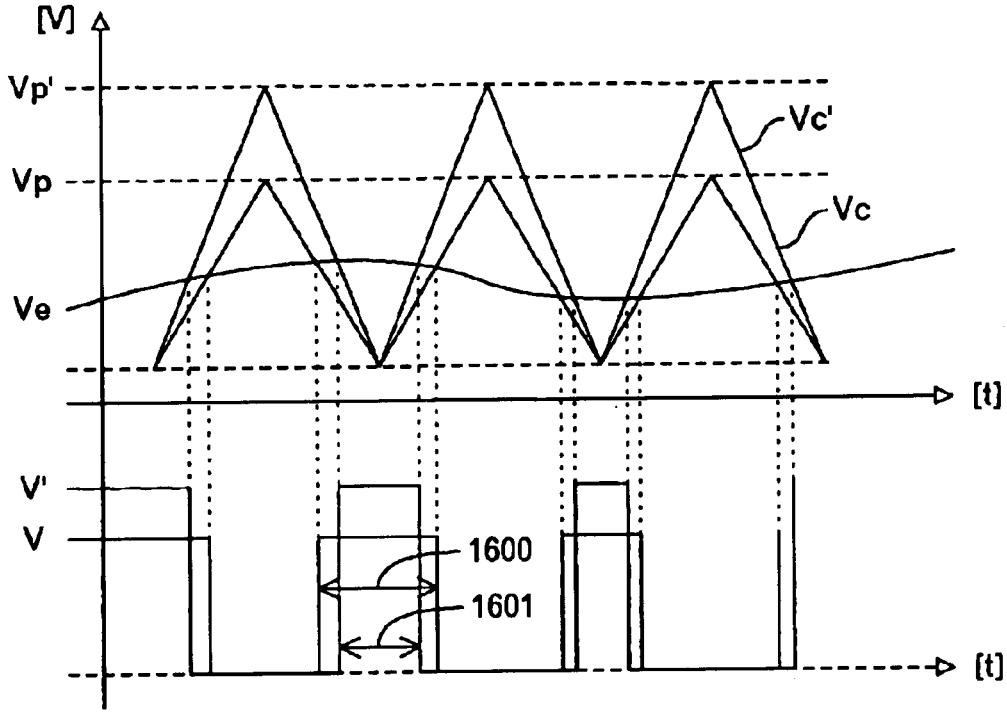
FIG. 24 is a waveform diagram of another embodiment of the power converter.

However, the power converter 3 may not be a circuit for changing the inclination of the triangular wave in accordance with the input voltage Vi as described in the first embodiment. For example, because the relation of Kp=Vi/Vp (Vp denotes the peak voltage of the triangular wave) is established, in the case where the input voltage Vi becomes high, when Vp is also made high similarly, Kp becomes constant. FIG. 24 shows an example. The vertical axis indicates voltage [V], and the horizontal axis indicates time [t]. The peak voltage of the triangular wave rises to Vp' because the input voltage Vi rises. However, because the period of the triangular wave is not changed, the same effect as the case where the inclination of the triangular wave becomes large is obtained. That is, in the conventional input voltage Vi, although the voltage Vc of the triangular wave is changed as shown in FIG. 24, when the voltage is increased from the input voltage Vi to the input voltage Vi', the voltage of the triangular wave is changed like Vc'. Thus, even if the output Ve of the controller 2 is the same, a time 1601 in which the voltage Vc' of the triangular wave after the peak voltage rises becomes Ve or lower, becomes shorter than a time 1600 in which the voltage Vc of the conventional triangular wave becomes Ve or lower. Accordingly, when the input voltage Vi rises, although the input voltage to the LC filter 1 also rises from V to V', the multiplying of VT is kept constant, because the ON time of the MOSFET 35 becomes short. Thus, even when the circuit for changing the peak voltage of the triangular wave in accordance with the input voltage Vi is used, a similar effect can be obtained.

Incidentally, the reason why the relation of Kp=Vi/Vp is established is that because the ratio d is d=Ve/Vp when the MOSFET 35 is turned on, the relation of d×Vi=Kp×Ve is established, and the relation of Kp=d×Vi/Ve=Vi/Vp is established. Incidentally, Vp may be a value of upper limit Vpmax−lower limit Vpmin.

Although the embodiments of the invention have been described, the circuit constants of the invention are not limited to those shown in the first, second and third embodiments, and a combination of any numerical values may be adopted as long as the foregoing features can be realized.

Besides, the configuration of the power converter 3 is not limited to the foregoing configuration, and for example, a technique disclosed in JP-A-59-144364 may be used. That is, there are included a switch for turning on and off an input voltage, a switching power supply circuit for smoothing a signal, which is turned on and off by the switch, by an LC filter to obtain an output voltage, a current detection circuit for detecting a current of an inductor in the LC filter of the switching power supply circuit, a voltage detection circuit for detecting an output voltage of the switching power supply circuit, and a pulse width modulation circuit receiving outputs of the current detection circuit and the voltage detection circuit to control the on/off time of the switch. Thus, the output voltage detected by the voltage detection circuit is fed back to the pulse width modulation circuit, and the signal corresponding to the current detected by the current detection circuit is also fed back, so that the influence of the input voltage fluctuation is suppressed.

Further, for the configuration of the power converter 3, for example, a technique disclosed in Japanese Patent No. 3161839 may be used. That is, there are included a main circuit made of a chopper circuit including a switching element and an inductor and for performing DC voltage conversion by radiating energy, which is stored in the inductor during an ON period of the switching element, to an output side during an OFF period of the switching element, and a control circuit for controlling the ON/OFF of the switching element. Then, the control circuit includes an error detector for outputting, as an error voltage, a difference between a detected voltage proportional to an output voltage of the main circuit and a set voltage, a judgment controller for turning off the switching element and discharging a capacitor when a voltage between both ends of the capacitor, which is charged at a predetermined time constant by turning on the switching element, reaches the error voltage, and for turning on the switching element when it is detected that the stored energy of the inductor is radiated until it becomes a predetermined value or less, and an ON time adjuster for performing adjustment in a direction to lessen the time constant when an input voltage rises so that the output voltage of the main circuit is kept constant against a fluctuation in input voltage.

Further, for example, a technique disclosed in JP-A-2002-252979 may be used for the configuration of the power converter 3. That is, in a switching power supply for controlling an output voltage by an ON width signal of a switching element, there are included a PWM comparator for determining an ON width, an oscillator in which a frequency is constant and the inclination of a triangular wave is changed by an input voltage, and an error amplifier for amplifying a difference between the output voltage and a reference voltage, and the PWM comparator compares an output waveform of the oscillator with an output of the error amplifier to form the ON width signal.

Further, for example, a technique disclosed in U.S. Pat. No. 5,278,490 may be used for the configuration of the power converter 3. This patent is incorporated herein by reference. That is, a switching circuit of this patent includes an input node, an output node, a reference node, a switch, and a feedback control circuit for cycling the switch in a series of cycles of a variable switch duty ratio in order to produce a chopped signal at the output node. One form of the feedback control circuit integrates the chopped signal during each cycle in order to produce a feedback signal indicative of the average value of the chopped signal during each cycle. A comparator circuit produces a control signal indicative of an occurrence of a condition in which the level of the feedback signal equals the level of the reference signal, and a switch control circuit varies the switch duty ratio according to the occurrence of that condition in order to maintain the average value of the chopped signal linearly related to the reference signal. Another form of the feedback control circuit produces a feedback signal indicative of the difference between the time-integrated value of the chopped signal and the time-integrated value of a reference signal coupled to the reference node during each cycle. A comparator circuit produces a control signal indicative of an occurrence of a condition in which the difference between the time-integrated value of the chopped signal and the time-integrated value of the reference signal is zero, and a switch control circuit varies the switch duty ratio according to the occurrence of that condition without integrator reset.

Further, for example, a technique disclosed in U.S. Pat. No. 5,055,767 may be used for the configuration of the power converter 3. This patent is incorporated herein by reference. That is, the switching voltage regulator circuit includes an input for connection to a source of input voltage for the switching voltage regulator circuit, a current switching means, oscillator means for controlling the one and off switching frequency of the current switching means, and further includes error amplifier means in the feedback loop. An integrated circuit for use in implementing a feed back loop in a switching voltage regulator circuit comprises: analog multiplier means for providing a signal to control the on and off switching duty cycle of the current switching means. The signal has a magnitude which varies immediately with and substantially in proportion to changes in a value equal to the magnitude of an error signal from the error amplifier means divided by the magnitude of the input voltage of the switching voltage regulator circuit.

Incidentally, any of the five publications as stated above does not disclose the frequency characteristic corresponding to the trap point of the present invention, and do not have a unique conception of the present invention that the input fluctuation has an influence on the stability in the case where the trap point is produced in order to improve the response, and therefore, they do not motivate the present invention.

Although the present invention has been described with respect to a specific preferred embodiment thereof, various change and modifications may be suggested to one skilled in the art, and it is intended that the present invention encompass such changes and modifications as fall within the scope of the appended claims.

What is claimed is:

1. A power supply apparatus, comprising:

a power conversion circuit converting an input voltage from an input power supply into a predetermined voltage;

an input fluctuation control circuit connected to said power conversion circuit, suppressing fluctuation of said input voltage;

an LC filter smoothing an output of said power conversion circuit and supplying the smoothed output of said power conversion circuit to a load; and a control circuit controlling said power conversion circuit based on an output voltage of said LC filter, and wherein an open-loop transfer function calculated by a transfer function of said power conversion circuit, a transfer function of said LC filter and said load, and a transfer function of said control circuit realizes a frequency characteristic having a phase trap.

2. The power supply apparatus as set forth in claim 1, wherein said input fluctuation control circuit controls said output of said power conversion circuit so as to be constant in multiplying voltage by time.

3. The power supply apparatus as set forth in claim 1, wherein said frequency characteristic having said phase trap is a frequency characteristic without a gain margin.

4. The power supply apparatus as set forth in claim 1, wherein said frequency characteristic having said phase trap is a frequency characteristic having only a phase margin among a gain margin and said phase margin.

5. The power supply apparatus as set forth in claim 1, wherein said frequency characteristic having said phase trap is a frequency characteristic in which a gain exceeds 0 dB at a frequency at which a phase becomes −180 degrees.

6. The power supply apparatus as set forth in claim 5, wherein said frequency at which said phase becomes −180 degrees is set within a frequency range from a resonant frequency of said LC filter to a gain crossover frequency.

7. The power supply apparatus as set forth in claim 1, wherein said frequency characteristic having said phase trap is a frequency characteristic in which a gain exceeds 0 dB at a frequency at which a phase is most delayed.

8. The power supply apparatus as set forth in claim 7, wherein said frequency at which said phase is most delay is set within a frequency range from a resonant frequency of said LC filter to a gain crossover frequency.

9. The power supply apparatus as set forth in claim 1, wherein said input fluctuation control circuit comprises:

a circuit generating a first signal whose inclination varies in accordance with said input voltage;

a circuit comparing said first signal with a second signal from said control circuit, and outputting a third signal if a voltage of said first signal becomes an voltage of said second signal or more; and a circuit generating a driving signal that is turned ON in response to a clock signal and is turned OFF in response to said third signal.

10. An power supply apparatus, comprising:

a power conversion circuit converting an input voltage from an input power supply into a predetermined voltage;

an input fluctuation control circuit connected to said power conversion circuit, suppressing fluctuation of said input voltage;

an LC filter smoothing an output of said power conversion circuit and supplying the smoothed output of said power conversion circuit to a load; and a control circuit controlling said power conversion circuit based on an output voltage of said LC filter, and wherein said control circuit has a PID control function, and an integral control element is applied at frequencies higher than a resonant frequency of said LC filter.

11. The power supply apparatus as set forth in claim 10, wherein said control circuit is a circuit in which a differential control element is applied at frequencies lower than a gain crossover frequency.

* * * * *